US012378018B2

(12) United States Patent
Scafaria et al.

(10) Patent No.: US 12,378,018 B2
(45) Date of Patent: Aug. 5, 2025

(54) CARTRIDGE FILLER AND CAPPING MACHINE FOR FILLING AND CAPPING CARTRIDGES WITH CONSUMABLE FLUIDS

(71) Applicants: Steve Scafaria, Kalamazoo, MI (US); Derek Nelson, Stevensville, MI (US); Tammy Lui, Mendon, MI (US)

(72) Inventors: Steve Scafaria, Kalamazoo, MI (US); Derek Nelson, Stevensville, MI (US); Tammy Lui, Mendon, MI (US)

(73) Assignee: Technical Packaging Systems, Inc., Kalamazoo, MI (US)

( * ) Notice: Subject to any disclaimer, the term of this patent is extended or adjusted under 35 U.S.C. 154(b) by 177 days.

(21) Appl. No.: 17/809,227

(22) Filed: Jun. 27, 2022

(65) Prior Publication Data

US 2023/0174257 A1 Jun. 8, 2023

Related U.S. Application Data

(60) Provisional application No. 63/362,146, filed on Mar. 30, 2022, provisional application No. 63/215,187, filed on Jun. 25, 2021.

(51) Int. Cl.
*B65B 3/18* (2006.01)
*A24F 40/42* (2020.01)
(Continued)

(52) U.S. Cl.
CPC ..... *B65B 3/18* (2013.01); *A24F 40/42* (2020.01); *B65B 3/14* (2013.01); *B65B 39/004* (2013.01); *B65B 39/04* (2013.01)

(58) Field of Classification Search
CPC .... B65B 3/04; B65B 3/12; B65B 3/14; B65B 3/18; B65B 39/004; B65B 39/04; A24F 40/42
See application file for complete search history.

(56) References Cited

U.S. PATENT DOCUMENTS 3,034,627 A * 5/1962 Nichols ..... G07F 15/12 194/246
8,757,169 B2 * 6/2014 Gysland ..... A24F 40/00 131/270
(Continued)

FOREIGN PATENT DOCUMENTS

FR 3034627 B1 4/2015
WO WO-2016105191 A1 * 6/2016 ..... B65B 29/00
(Continued)

*Primary Examiner* — Nicolas A Arnett
(74) *Attorney, Agent, or Firm* — Mark L. Maki; Miller Canfield

(57) ABSTRACT

A cartridge handling machine for vape type cartridges is provided, which may comprise a filling module for filling of cartridge bodies with viscous consumable fluids, particularly oils extracted from hemp and cannabis and compositions thereof. The cartridge handling machine may also comprise a capping module to provide for synchronized filling of the filled cartridges and capping the cartridges with a cap, such as a mouthpiece or other cap device developed for such cartridges. The individual filling and capping modules can be operated independent of each other such that the cartridge handling machine preferably comprises both a filling module and capping module that preferably are integrated together for synchronized operation, although these modules may also be constructed and operated as separate machines for the respective filling and capping of these types of vape cartridges.

43 Claims, 33 Drawing Sheets

(51) Int. Cl.

| | |
|---|---|
| ***B65B 3/14*** | (2006.01) |
| ***B65B 39/00*** | (2006.01) |
| ***B65B 39/04*** | (2006.01) |

(56) References Cited

U.S. PATENT DOCUMENTS

| | | | | |
|---|---|---|---|---|
| 9,668,520 | B2 * | 6/2017 | Boldrini | B65B 3/06 |
| 10,015,989 | B2 * | 7/2018 | Davis | F16K 15/00 |
| 10,238,145 | B2 * | 3/2019 | Guenther, Jr. | B23P 19/002 |
| 10,440,989 | B2 * | 10/2019 | Gardella | B65B 39/12 |
| 10,562,748 | B2 * | 2/2020 | Garthaffner | B65B 37/20 |
| 10,583,949 | B1 * | 3/2020 | Ellis | B65B 3/12 |
| 10,822,123 | B2 * | 11/2020 | Barbaric | B67D 7/0288 |
| 10,850,874 | B2 * | 12/2020 | Boldrini | B65B 3/28 |
| 11,612,189 | B2 * | 3/2023 | Chao | B65B 3/003 131/328 |
| 11,679,905 | B1 * | 6/2023 | Ellis | B65B 3/003 141/1 |
| 11,858,672 | B2 * | 1/2024 | Joseph | B65B 3/24 |
| 11,932,432 | B1 * | 3/2024 | Bausch | B65B 3/12 |
| 2015/0336689 | A1 * | 11/2015 | Brown | B65B 3/04 141/370 |
| 2016/0200463 | A1 * | 7/2016 | Hodges | G07F 13/06 53/136.3 |
| 2017/0121169 | A1 * | 5/2017 | Dailey | B65B 57/145 |
| 2018/0016040 | A1 * | 1/2018 | Ewing | B65B 3/26 |
| 2020/0156811 | A1 * | 5/2020 | Milandri | A24F 40/20 |
| 2020/0315258 | A1 * | 10/2020 | Yuan | A24F 40/42 |
| 2021/0120885 | A1 * | 4/2021 | Xie | A24F 40/48 |

FOREIGN PATENT DOCUMENTS

| | | | |
|---|---|---|---|
| WO | 2019106504 | A1 | 6/2019 |
| WO | 2019228866 | A1 | 12/2019 |
| WO | 2020157461 | A2 | 8/2020 |

* cited by examiner

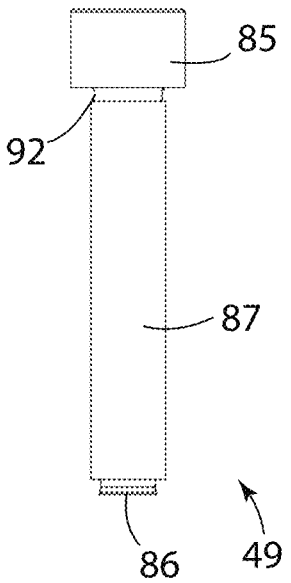
FIG. 15
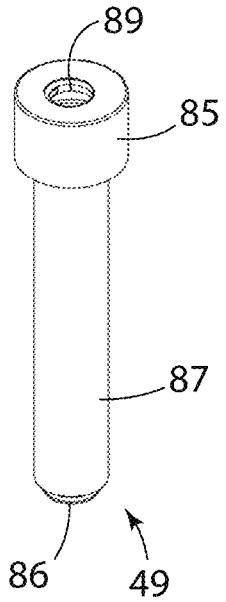
FIG. 16
FIG. 17
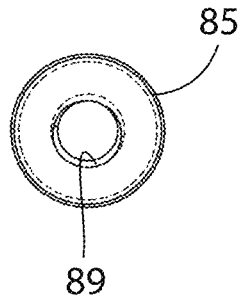
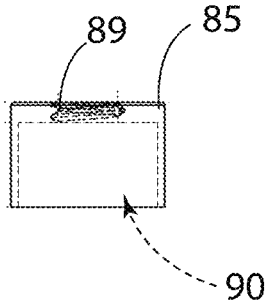
FIG. 18
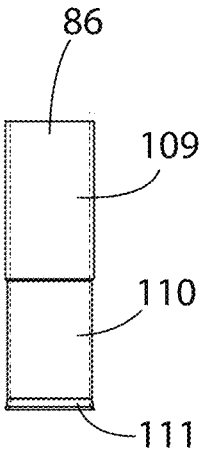
FIG. 19
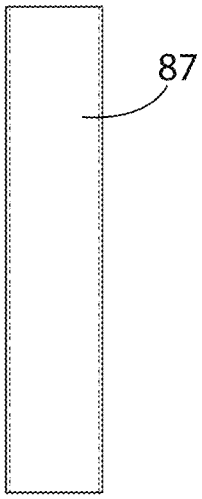
FIG. 20

CARTRIDGE FILLER AND CAPPING MACHINE FOR FILLING AND CAPPING CARTRIDGES WITH CONSUMABLE FLUIDS

CROSS REFERENCE TO RELATED APPLICATIONS

This application claims priority of U.S. Provisional Patent Application No. 63/215,187, filed Jun. 25, 2021, and priority of U.S. Provisional Patent Application No. 63/362,146, filed Mar. 30, 2022, both copending herewith, the disclosures of which are incorporated herein by reference in their entireties.

FIELD OF THE INVENTION

The invention relates to a machine for filling cartridges with consumable fluids and capping same, and more particularly to an improved machine for filling vape-type cartridges with a viscous consumable fluid such as plant-based oils extracted from cannabis and hemp.

BACKGROUND OF THE INVENTION

In conventional, electronic cigarettes, or e-cigarettes, a cartridge is typically provided, which contains fluids containing nicotine, flavorings and other compounds. Such devices are also known as vaping or vape devices or vape pens for vaping the liquid contained therein. These devices typically are battery-operated to convert the liquid in the cartridge into a vapor that can be inhaled by the user. Such cartridges typically may have a container body for storing the liquid, a heater, atomizer or other similar device to vaporize the liquid into a vapor, and a cap, which often is formed as a mouthpiece for facilitating the inhalation of the vapor by the user.

With the legalization of cannabis and THC in many states, such cartridges and vaping devices have been adapted for vaping of liquids containing THC. In particular, the liquid is in the form of cannabis oil or a solution containing such cannabis oil. Further, CBD products have been legalized, and CBD oil may also be extracted from a hemp plant and provided in a form suitable for vaporization and vaping. The terms CBD oil and cannabis oil as used with respect to the present invention may encompass both the oils and solutions containing such oils.

Such oils are typically produced by extracting such oils from the cannabis or hemp plant using a solvent, and then refining the extracts to form a plant-based oil that may be consumed by itself or as a solution, wherein for the purposes of this disclosure, the term consumable fluid encompasses both an extract and a solution thereof. As noted, the consumable fluid may particularly be constituted as a plant-based consumable oil containing CBD, THC or other plant compounds suitable for vaping. This consumable fluid can be vaporized by a vaping device having an atomizer or heated cartridge, and inhaled similar to the use of e-cigarettes.

Despite the similarities between vaping a consumable oil in this manner and vaping e-cigarette liquids, e-cigarette liquids may be thinner and exhibit different physical properties when used and when packaging such nicotine-containing e-cigarette liquids in a cartridge. However, cannabis and hemp based oils may be relatively thick and viscous, and tend to create more difficulties in packaging such fluids within a cartridge for a vape device due to the viscosity which can create difficulties in maintaining the oil in a suitably viscous state for filling of a cartridge.

Further, depending upon strains and compositions of such plant based oils, the viscosity may vary from strain to strain or possibly between different batches of the same strain. As noted, such oils have a greater viscosity that can increase the potential for coagulation and clogging during the process of filling the cartridges.

While cartridge filling machines are known for cartridges containing both e-cigarette fluids and cannabis oils, additional challenges are associated with filling cartridges with cannabis oil containing THC, CBD oil, or combinations and solutions containing such plant-based fluids. Therefore, some cartridge filling machines are specifically designed for use with cannabis oils. In one example, U.S. Pat. No 10,583,949 B2 discloses a filling machine with a reservoir, a fluid pump and an injector needle for dispensing cannabis oil into a central inlet port of the cartridge. Heaters may be provided in these components including the reservoir for the bulk oil, the delivery pump, and the needle for injecting a narrow stream into the cartridge body. In this prior art patent, a movable cartridge holder is provided, which moves the cartridge up and down for filling by the stationary injector needle.

Nevertheless, there is a need for improved cartridge filling machines, particularly those used with consumable fluids having viscosities greater than e-cigarette liquids.

In more detail, the present invention is particularly suitable in overcoming disadvantages associated with prior art machines, and provides an improved system to fill cartridges with viscous cannabis or hemp oils including those containing extracts of cannabis and hemp such as THC, cannabinoids including CBD, terpenes, flavonoids and compounds thereof. These types of consumable fluids present greater challenges to the filling of vape cartridges in comparison to lower viscosity fluids used in e-cigarettes, and the present invention is believed to overcome such disadvantages.

The present invention relates to a cartridge handling machine for vape cartridges of this type, which includes an inventive filling module, which filling module provides improvements over prior art machines. The filling module may be used by itself or may be provided in combination with a capping module wherein the combination provides for synchronized filling of the cartridges with viscous consumable oils and capping of the cartridges with a cap, such as a mouthpiece or other cap device developed for such cartridges. The individual filling and capping modules can be operated independent of each other such that the inventive cartridge handling machine comprises both a filling module and capping module that preferably are integrated together for synchronized operation although these inventive modules may also be constructed and operated as separate machines for the respective filling and capping of these types of vape cartridges.

The filling module operates in conjunction with a conveyor assembly which operates to sequentially convey and feed empty cartridge bodies to the filling module, preferably through a turntable which transports the empty cartridge bodies to a filling station. The filling module preferably contains a feed tank for storing a bulk quantity of consumable fluid, and a pump which receives the bulk fluid therefrom and in turn pumps the consumable fluid to an injector assembly. The consumable fluid is pressurized and pumped to the injector assembly for dispensing to an empty cartridge body located in the filling station. When the cartridge body reaches the fill position, an injector nozzle of the injector assembly of the filling module engages an open mouth of the cartridge body and injects the consumable fluid therein. In the inventive injector nozzle, an annular injector passage or port is provided, through which the fluid is discharged. The central portion of the injector nozzle is dead space which is separated from the injector passage by an interior wall and does not dispense the fluid. The annular injector passage forms an annular pattern of fluid discharge, preferably shaped in a circle throughout 360 degrees.

In typical cartridge bodies, there may be a central tube surrounded by an annular, open mouth opening into the main fluid compartment of the cartridge body. As noted, the inventive injector nozzle preferably defines the annular injector passage so that the consumable fluid is injected through 360 degrees about the entire injector passage into the annular mouth and generates uniform injection throughout the annular cartridge mouth. In this configuration, air may be displaced out of the cartridge body and may escape through the open mouth without trapping bubbles. This prevents the formation of air pockets or bubbles within the cartridge body during the filling step.

The injector nozzle engages with the annular mouth in a generally sealed relation so that pressurized fluid is injected into the mouth, wherein the 360 degree or annular injection pattern and pressurized fluid also facilitates priming of the cartridge wick of the atomizer preinstalled within the cartridge body.

To improve the injectability of the viscous fluid, one or more of the storage tank, pump, injector nozzle and at least one intermediate passage between such components may be provided with respective heaters or heating units. Preferably, all of such components include respective heating units to provide a continuous flow path between the storage tank and injector port that is heated in order to reduce or control the fluid viscosity and maintain the viscosity of the fluid at an optimum level for pumping and injection into the cartridge body. As mentioned, specific fluids of this type, such as different cannabis and CBD oils, can vary in viscosity and the present invention allows adjustment of the heating levels to maintain the fluid at a governed viscosity that is most suitable for injection of such fluid into the cartridge body.

Still further, the storage tank, pump, and injector nozzle preferably are mounted together on a movable carriage so that the injector nozzle can be moved downward into sealing engagement with the cartridge mouth for filling of the cartridge body. The carriage is reversible for raising and disengaging the injector nozzle once the cartridge body is filled. All of such components preferably may move together on the carriage so that the distance between the storage tank and injector nozzle essentially remains fixed and the heater units can provide uniform, controllable heat to these components.

The conveyor assembly also operates in conjunction with the capping module to displace the filled cartridge body to a capping station and a capping position thereof. The filled cartridge body is transported or conveyed to the capping position, and the capping module operates to install a cap onto the cartridge body. The cap typically may be a mouthpiece although it is not limited to such a construction. Further, the cap may be secured to the cartridge body by a screw engagement or a press fit engagement or other engagement configuration.

The inventive capping module is readily configurable to mount the cap to the cartridge body by screw engagement, press fit engagement or other engagement means through modification of an inventive installation chuck provided on the capping module. The installation chuck is interchangeable and may rotate for a screw engagement, may displace linearly for a press fit and may be modified to accommodate other engagement means as required.

Further, the capping module incorporates an inventive feed assembly having a cap carrier that moves between a loading position and a capping position. In the loading position, the cap carrier receives a cap and holds same in a temporary storage position therein. The cap carrier displaces to the capping position, which aligns the carrier with the installation chuck, wherein the installation chuck then displaces or operates to drive the cap from the storage position toward and into engagement with the cartridge body. As noted above, the chuck may drive the cap into press fit engagement, rotate the cap into screwed or threaded engagement or may otherwise position or displace the cap depending upon any other engagement means being provided. It will be understood that the term press fit will encompass both a tight-fitting interference fit, and a snap fit or other fastener fit wherein engagement results from axial displacement of the cap toward the cartridge body. The screw fit or threaded fit may also be referenced as a rotary fit, which may also encompass other fastening means in which rotation effects fixing of the cap on the cartridge body.

The feed assembly includes a cap loader, which incrementally loads the caps into the cap carrier, preferably by dropping the caps one at a time into the carrier, which are held in an interior chamber in a temporary storage position. The interior chamber may include a releasable stop that stops and holds the caps in the interior chamber of the carrier, but releases the cap when the chuck engages the cap and drives the cap out of the chamber for connection to the cartridge body.

The caps preferably are prepositioned in the cap loader in a row and are fed along a feed path until discharged such that the cap will drop by gravity from the cap loader into the carrier. Feeding and discharge of the caps is synchronized with the chuck movement and may also be synchronized with the conveyor unit and/or the fill module so that continuous synchronous operation of the fill module and capping module occurs. Or, as noted above, the capping module may be synchronized with the conveyor module if alternate filling means are provided.

The inventive cartridge handling machine and the individual modules thereof provide significant improvements and advantages over known machines used to fill cartridges with viscous consumable fluids comprising cannabis and/or CBD oil.

Other objects and purposes of the invention, and variations thereof, will be apparent upon reading the following specification and inspecting the accompanying drawings.

BRIEF DESCRIPTION OF THE DRAWINGS

FIGS. 15 and 16 are front elevation and perspective views of the injector nozzle.

FIGS. 17 and 18 are top and front views of an injector head.

FIG. 19 is a front elevation view of an end piece for the nozzle.

FIG. 20 is a front elevation view of an injector housing.

Figure 1:
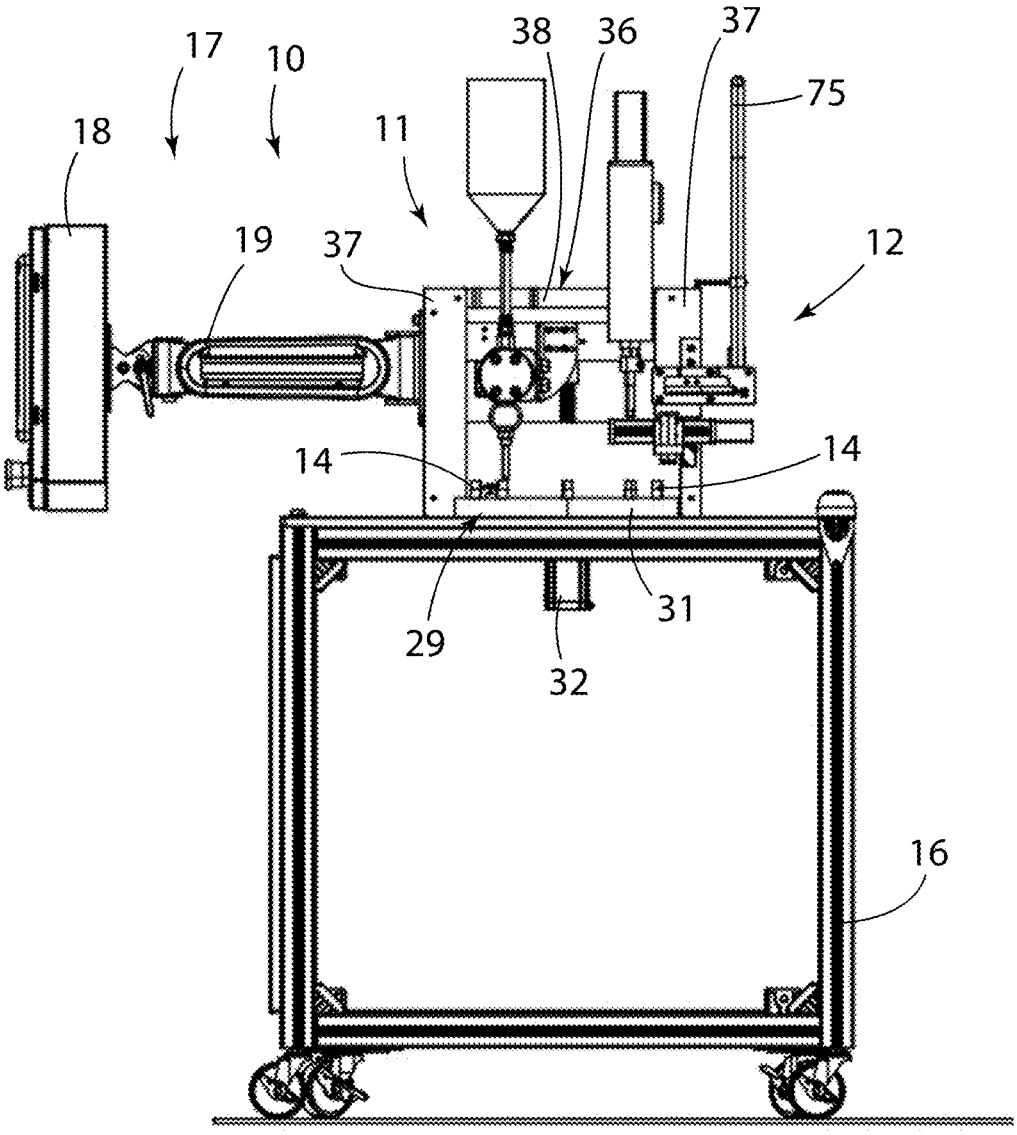
FIG. 1 is a front elevation view of a cartridge handling machine for vape-type cartridges comprising filling and capping modules.
Figure 2:
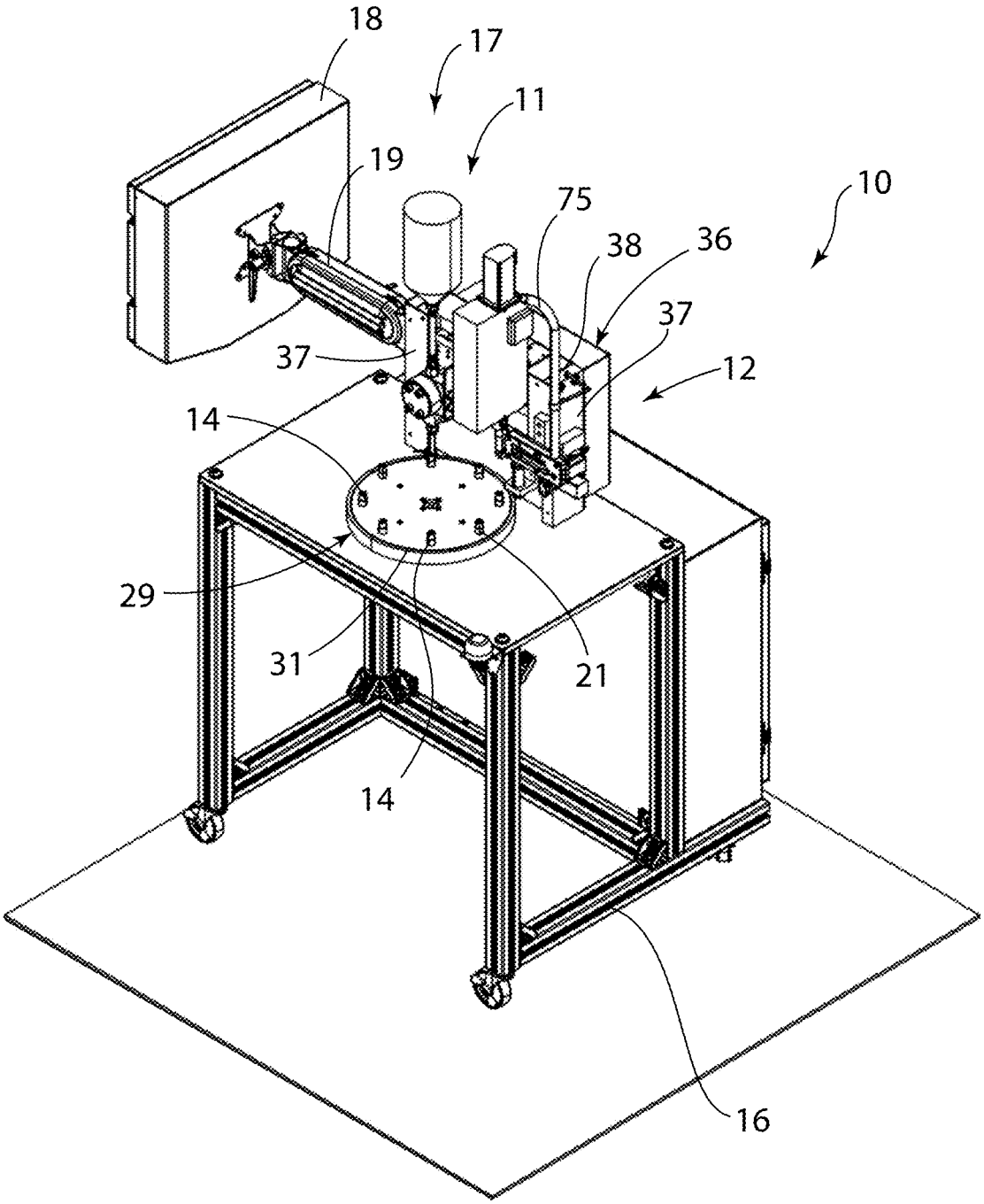
FIG. 2 is a front right perspective view of the cartridge handling machine.
Figure 3:
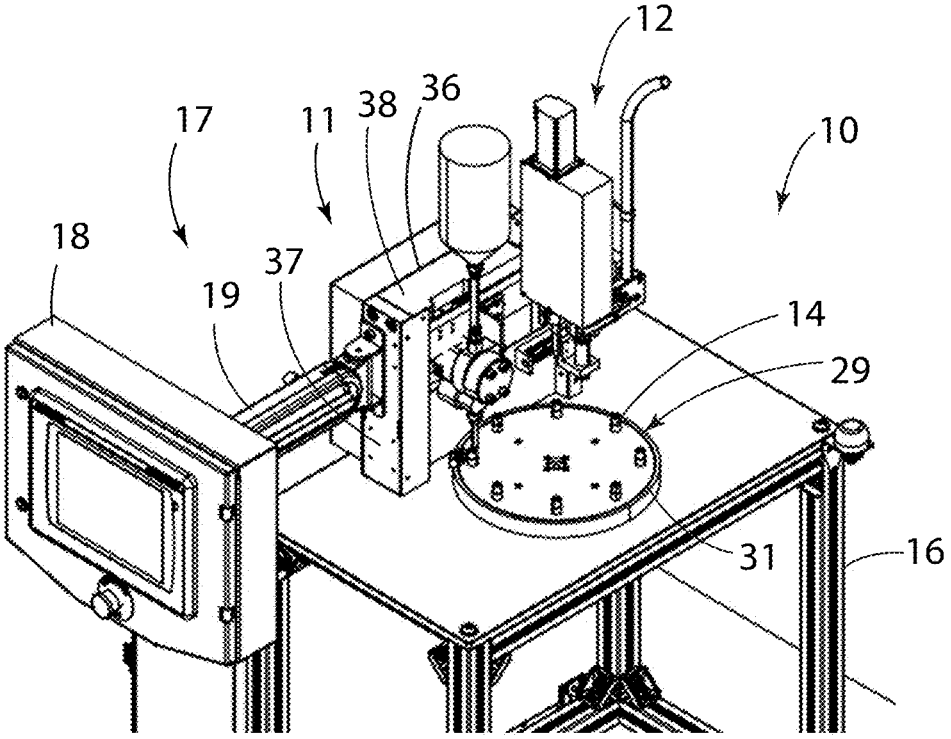
FIG. 3 is a front left perspective view thereof.
Figure 4:
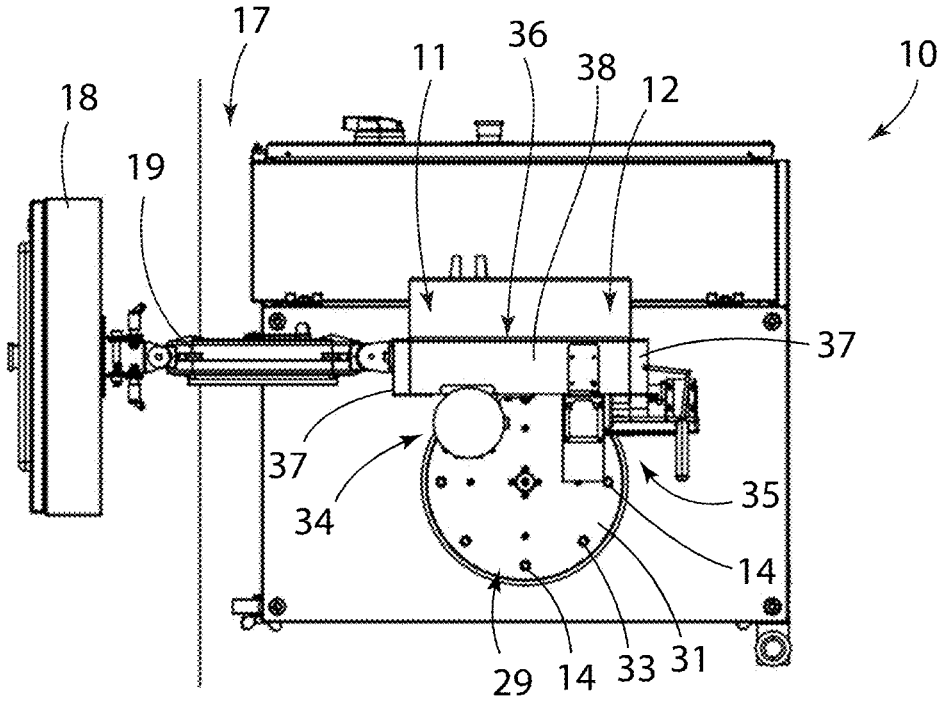
FIG. 4 is a top view thereof.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

FIGS. 1-4 illustrate a cartridge handling machine 10 according to the present invention, which is provided for vape-type cartridge filling. The cartridge handling machine 10 includes an inventive filling module 11, which may be used by itself or may be provided in combination with a capping module 12 wherein the combination of the modules 11 and 12 provides for synchronized filling of vape-type cartridge bodies 14 with viscous consumable oils and then capping of the cartridge bodies 14. The individual filling and capping modules 11 and 12 can be operated independent of each other such that the inventive cartridge handling machine 10 comprises both a filling module or machine 11 and capping module or machine 12 that preferably are integrated together for synchronized operation although these inventive modules 11 and 12 may also be constructed and operated as separate machines for the respective filling and capping of these types of vape cartridges.

The cartridge handling machine 10 comprises a mobile base 16, and a control system 17, which synchronizes operation of the filling module 11 and capping module 12. The control system 17 comprises a control display 18 shown on a swivel arm 19 for monitoring and controlling operation of the modules 11 and 12 as well as other components and sub-components thereof.

Figure 5A:
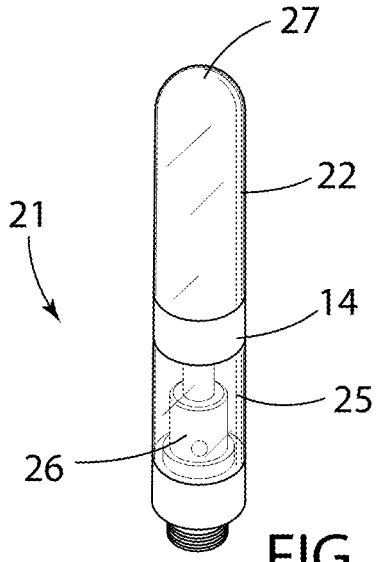
FIGS. 5A-5C are side, front and top perspective views of a representative vape-type cartridge usable with the present invention.
Figure 5B:
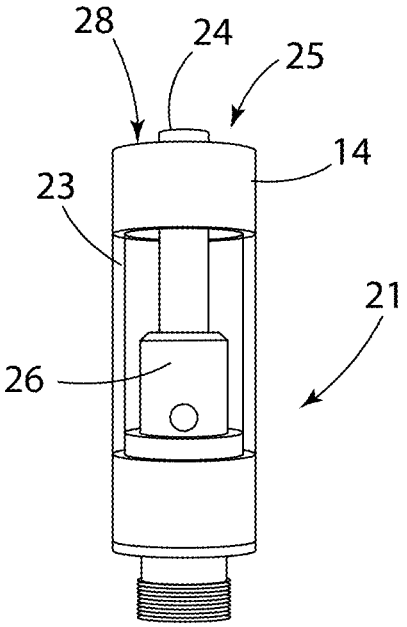
Figure 5C:
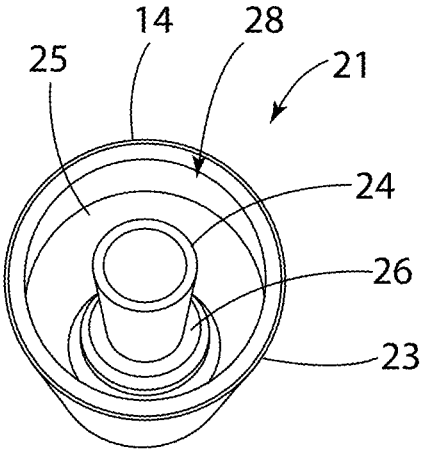

With respect to vape type cartridges usable with the present invention, FIGS. 5A-5C are side, front and top perspective views of a representative vape-type cartridge 21. The specific type of cartridge 21 may vary and the type shown is known and conventional. Typical cartridges would include the general components illustrated including the afore-mentioned cartridge body 14 and a mountable cap 22. The cartridge body 14 may include a body wall 23 surrounding an outlet tube 24 to define an annular chamber 25 in which the vape fluid is stored. The chamber 25 and outlet tube 24 communicate through a heater unit 26 that heats the vape fluid, vaporizes the fluid and discharges the vapor through the outlet tube 24. The cap 22 typically is a mouthpiece that includes an outlet passage 27 that receives the vapor from the outlet tube 24 and discharges the vapor for inhalation by a user. During filling when the cap 22 is absent, the body wall 23 and outlet tube 24 define an annular cartridge mouth 28 into which the vape fluid will be injected by the filling module 11. A more detailed understanding of such products is not required for an understanding of the present invention.

The cartridge handling machine 10 also includes a conveyor assembly 29, which operates in conjunction with the filling module 11 to feed empty cartridge bodies 14 thereto. Further, the conveyor assembly 29 operates in conjunction with the capping module 12 by transferring filled cartridge bodies 14 to the capping module 12 and then conveying capped cartridge bodies 14 away therefrom. As such, the conveyor assembly 29 operates to sequentially convey and feed empty cartridge bodies 14 to the filling module 11 and filled cartridge bodies 14 to and from the capping module.

In the preferred embodiment, the conveyor assembly 29 preferably comprises a rotary turntable 31 driven by a drive motor 32 (see FIG. 1). The turntable 31 is mounted on the top of the base 16 and has a peripheral edge portion which rotates under the filling module 11 and capping module 12. The edge portion has circumferentially spaced sockets 33 which receive the cartridge bodies 14 therein. During a normal filling and capping operation, the turntable 31 rotates at a speed synchronized by the controller 18 with the operation of the filling module 11 and capping module 12. This rotation may be incremental rotation wherein the turntable rotates to move cartridge bodies 14 and stops during the filling and/or capping steps, which preferably occur simultaneously but are not required to do so. The sockets 33 are filled with empty cartridge bodies 14 upstream of the filling module 11, wherein turntable rotation transports the empty cartridge bodies 14 to a filling station 34 generally located under the filling module 11 for filling thereby. Continued rotation of the turntable 31 conveys the filled cartridge bodies 14 to a capping station 35 generally located under the capping module 12 for capping thereby.

Once capped, the cartridges 21 are fully assembled and continued turntable rotation then conveys the completed cartridges 21 downstream of the capping module 12 so that the cartridges 21 can be removed for packaging and shipping. The cartridges 21 can be removed from the sockets 33 manually by an operator, and empty cartridge bodies 14 can then be loaded into the sockets 33 for subsequent filling. In the alternative, the sockets 33 can be emptied of cartridges 21 and refilled with empty cartridge bodies 14 by a separate pick-and-place module that could be provided with the filling and capping modules 11 and 12.

To synchronize operation, the cartridge handling machine 10 may include sensors to start and stop the various process steps. For example, a filling machine sensor 11A may be provided to detect the arrival of the next socket 33 that is ready for filling, which will stop the turntable rotation until the filling cycle is completed. This automatically positions a downstream socket 33 for the capping cycle. Further, a sensor may be provided in a socket 33 to detect a cartridge body 14 in the socket 33 at the capping station.

Figure 6A:
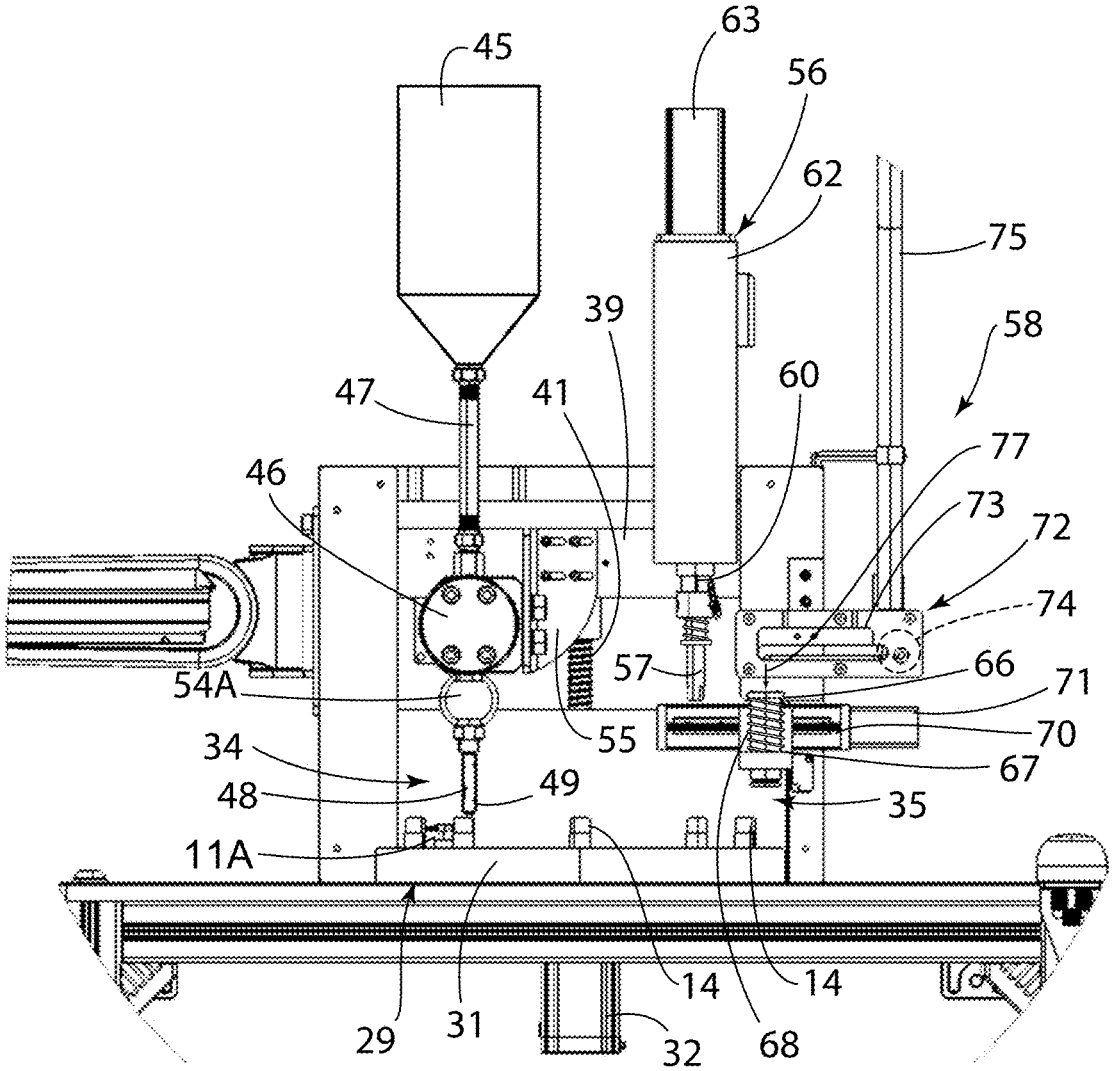
FIG. 6A is an enlarged front view of the filling and capping modules in an initial loading position before filling and capping of unfilled cartridge bodies.
Figure 6B:
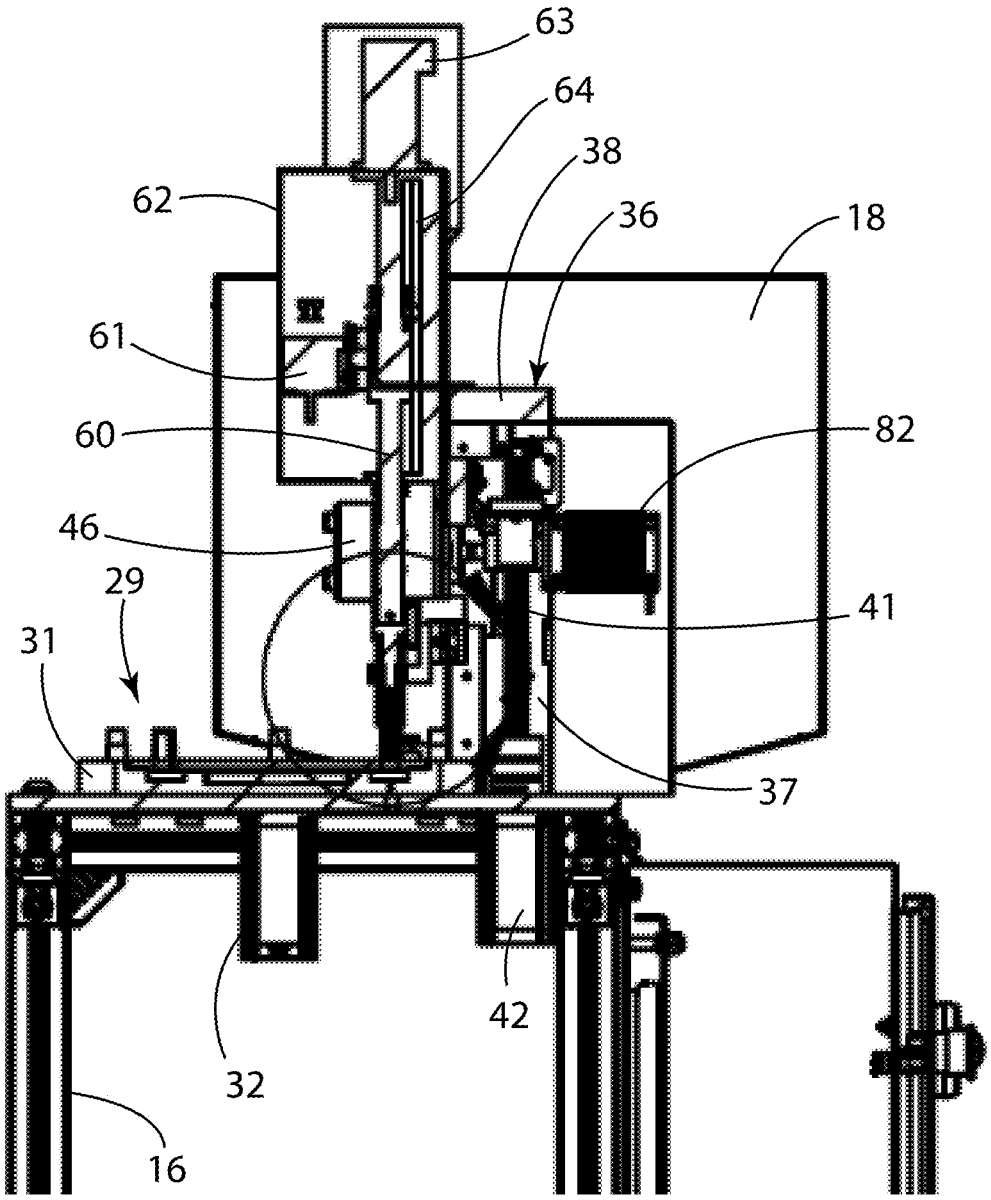
FIG. 6B is a side cross-sectional view thereof showing a carriage and drive assembly for operating the filling module.
Figure 13:
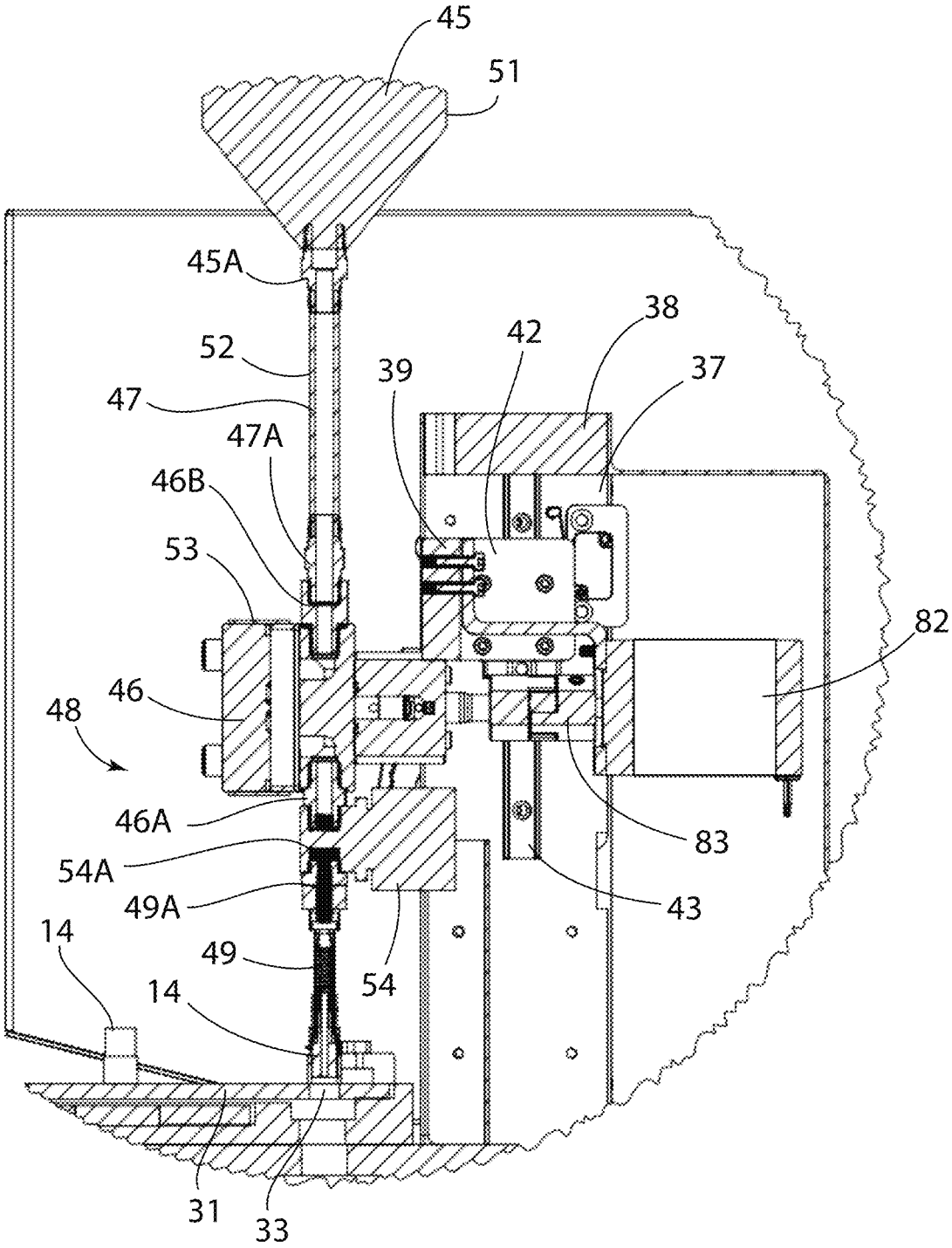
FIG. 13 is a right side cross sectional view as taken through the filling module.

To support the filling module 11 and capping modules 12, the machine 10 includes a U-shaped support frame 36 formed of two uprights 37 and a cross rail 38 as shown in FIGS. 1-4 and 6A. Generally, the capping module 12 is fixed in position on the support frame 36 although some components thereof will move during the capping operation. The filling module 11, however, is mounted on a movable carriage 39 as seen in FIGS. 6A and 6B, wherein the carriage 39 is movable vertically on the support frame 36 by a threaded drive shaft 40 and drive motor 41. As best shown in FIG. 13, the opposite ends of the carriage 39 include mounting flanges 42, which are slidably supported on vertical guide tracks 43. Both uprights 37 include such guide tracks 43 on the inside faces thereof, such that the carriage 39 travels vertically up and down depending upon the direction of rotation of the drive shaft 40 by the motor 41, wherein the motor 41 is driven by the control system and synchronized with the other system components.

Figure 7:
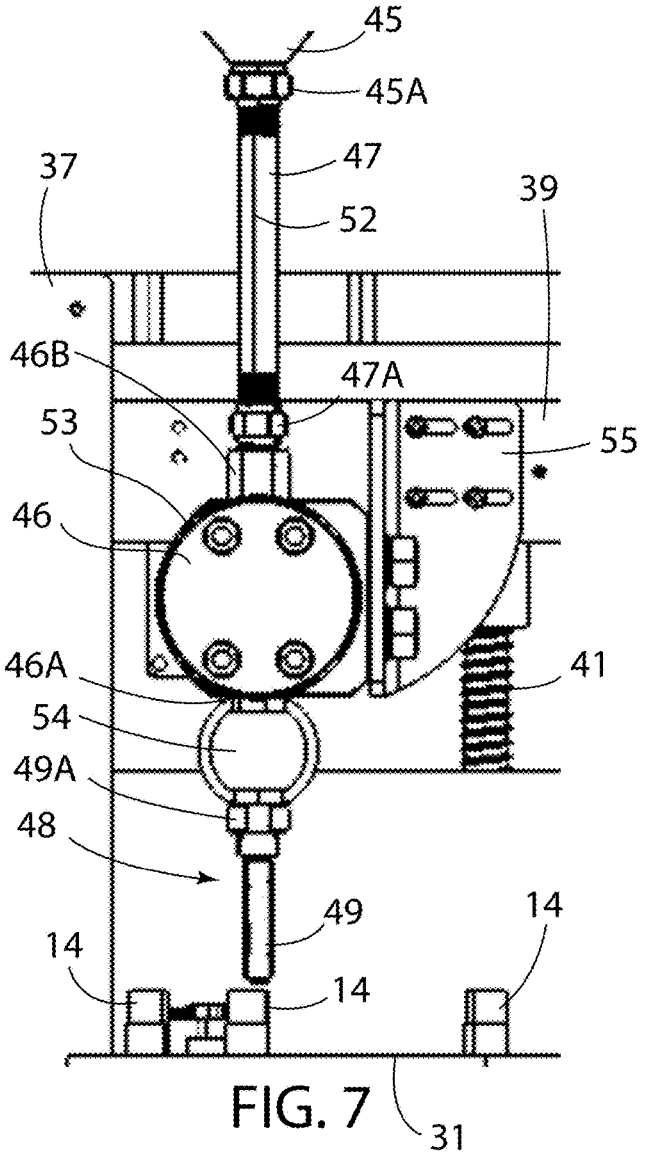
FIG. 7 is a front elevation view of the filling module with an injector nozzle raised before engaging a cartridge body for filling.
Figure 8:
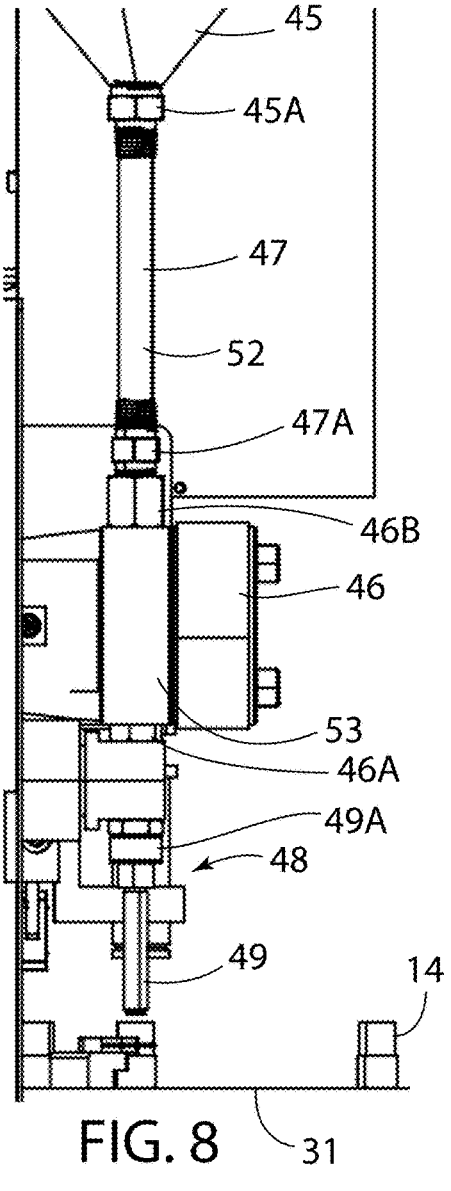
FIG. 8 is a left side view thereof.

In more detail as to FIGS. 6A, 7 and 8, FIG. 6A is an enlarged front view of the filling and capping modules 11 and 12 in an initial loading position before filling and capping of unfilled cartridge bodies 14. FIG. 7 is a partial front elevation view of the filling module 11 with in a raised position before engaging a cartridge body 14 for filling. Filling is accomplished by moving the filling module 11 downwardly by the carriage 39 as will be described in more detail below.

The filling module 11 preferably contains a feed tank or hopper 45 for storing a bulk quantity of consumable fluid, which fluid is of the type disclosed above at length such as cannabis or CBD oil. The filling module 11 also includes an injection pump 46, which receives the bulk fluid from the feed tank 45 through a vertical standpipe 47. The injection pump 46 in turn pumps the consumable fluid downstream to an injector assembly 48. The consumable fluid is thereby pressurized and pumped to the injector assembly 48 for dispensing to an empty cartridge body 14 located in the filling station 34.

When the cartridge body 14 reaches the fill position in the filling station 34, the injector assembly 48 is configured to move downwardly with the carriage 39 wherein an injector nozzle 49 of the injector assembly 48 engages the open mouth 28 of the cartridge body 14 and injects the consumable fluid therein as described further below. FIGS. 6A, 7 and 8 show the injector assembly 48 in the raised position, which provides vertical clearance as the empty cartridge bodies 14 are moved into the filling station 34 by the turntable 31. The consumable fluid may also be referenced herein is a fill fluid used to fill the cartridge bodies 14.

To improve the injectability of the viscous fluid, one or more of the storage tank 45, pump 46, injector assembly 48 and at least one intermediate passage between such components such as the standpipe 47 may be provided with respective heat sources. Preferably, all of such components include respective heating units to provide a continuous flow path between the storage tank 45 and injector nozzle 49 that is heated in order to reduce or control the fluid viscosity and maintain the viscosity of the fill fluid at an optimum level for pumping and injection into the cartridge body 14. As mentioned, specific fluids of this type, such as different cannabis and CBD oils, can vary in viscosity and the present invention allows adjustment of the heating levels to maintain the fluid at a governed viscosity that is most suitable for injection of such fluid into the cartridge body 14.

In more detail, the storage tank 45, pump 46 and standpipe 47 may be wrapped exteriorly with band heaters 51, 52 and 53. Further the injector nozzle 49 includes an additional heater 54 (FIG. 11) fluidly connected to the upstream side thereof such that fluid enters the injector nozzle 48 immediately after heating by the heater 54. A valve unit 54A may also be provided. As seen in more detail in FIG. 13, the upstream side of the injector nozzle 49 and the downstream side of the pump 46 are connected to the heater 54 and valve 54A by fittings 49A and 46A respectively, wherein the heater 54 and valve 54A defines an interior heating path through which the fluid flows and is heated.

These fittings 49A, 46A, and 46B further serve to support the injector assembly 48 and standpipe 47 on the pump 46, wherein the storage tank 45 in turn is supported on the standpipe 47. The pump 46 is fixedly mounted on the carriage 39 by mounting bracket 55 (FIG. 7), so that all of the interconnected components 45, 46, 47, 48 and 49 move together with the carriage 39.

As referenced above, the storage tank 45, pump 46, and injector assembly 48 and nozzle 49 preferably are mounted together on the movable carriage 39 so that the injector nozzle 49 can be moved downward into sealing engagement with the cartridge mouth 28 for filling of the cartridge body 14. The carriage 39 is reversible for raising and disengaging the injector nozzle 49 once the cartridge body 14 is filled. All of such components preferably may move together on the carriage 39 so that the distance between the storage tank 45 and injector nozzle 49 essentially remains fixed and the heater units 51, 52, 53 and 54 can provide uniform, controllable heat to these components and the fluid flowing therethrough.

Figure 9:
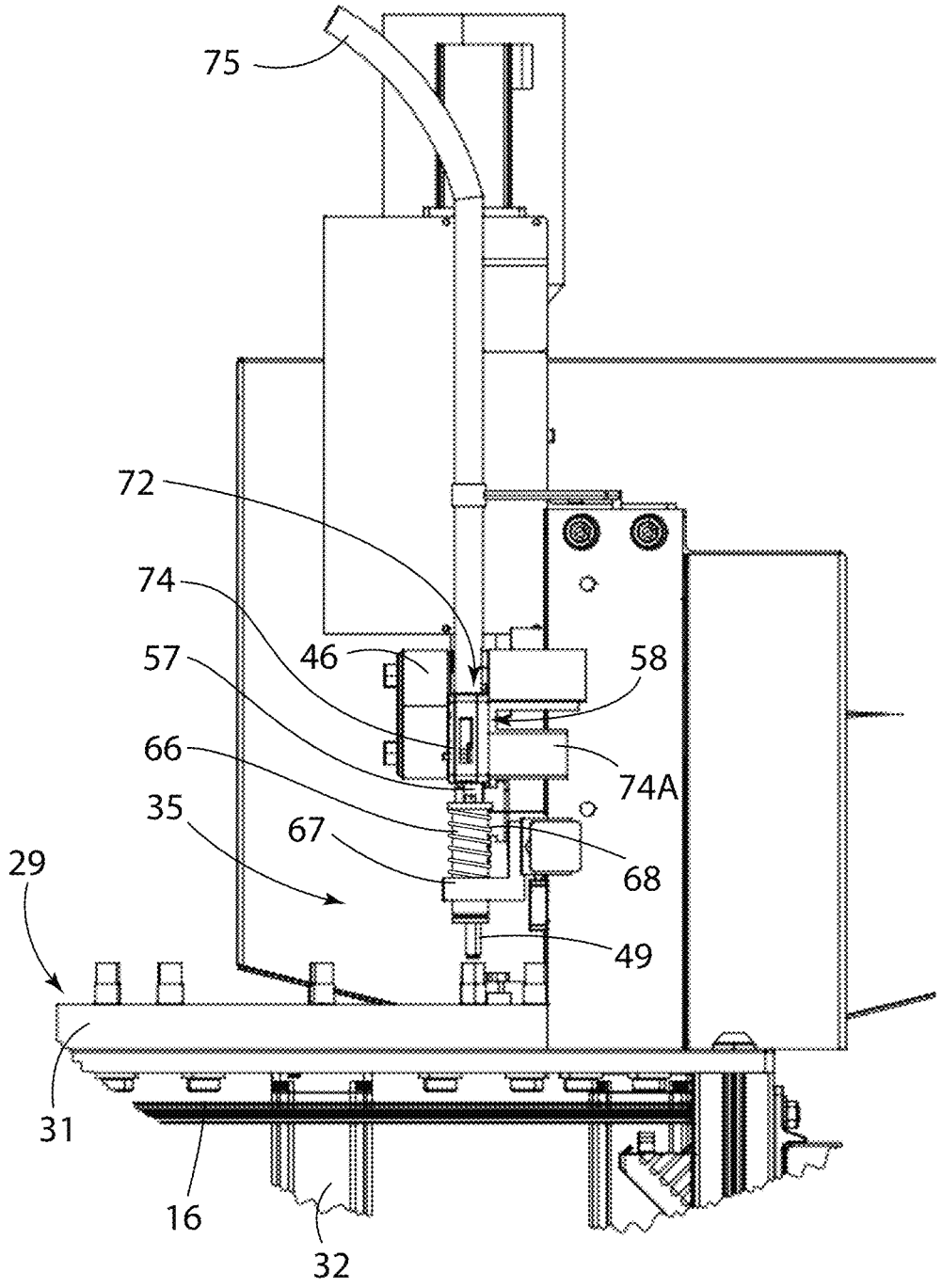
FIG. 9 is a right side view of the capping module with a capping chuck in a raised position before capping of a filled cartridge body.

Referring to FIGS. 6A and 9, the conveyor assembly 29 also operates in conjunction with the capping module 12 to displace the filled cartridge body 14 to a capping station 35 and a capping position thereof. The filled cartridge body 14 is transported or conveyed downstream to the capping station 35 under the capping module 12, and the capping module 12 generally operates to install a cap 22 onto the cartridge body. The cap 22 typically may be a mouthpiece although it is not limited to such a construction. As will be described further below, the cap 22 may be secured to the cartridge body 14 by a screw engagement or a press fit engagement or other engagement configuration.

The inventive capping module 12 is positioned on the support frame 36 downstream of the filling module 11. Generally, the capping module 12 comprises a capper assembly 56 that has a drive chuck or installation chuck 57 on the lower end thereof for driving a suitable cap 22 onto the filled cartridge body 14. The capping module 12 also includes a feed assembly 58 that stores a stock of new caps 22 and feeds the caps 22 to the capper assembly 56 so that the chuck 57 can be operated to fit the cap 22 onto a filled cartridge body 14.

The capper assembly 56 is readily configurable to mount the cap 22 to the cartridge body 14 by a screw fit or other rotary engagement, press fit engagement or other engagement means through modification of an inventive installation chuck 57 provided on the capper assembly 56. The installation chuck 57 is interchangeable and may rotate for a screw engagement, may displace linearly for a press fit and may be modified to accommodate other engagement means as required.

Figure 10:
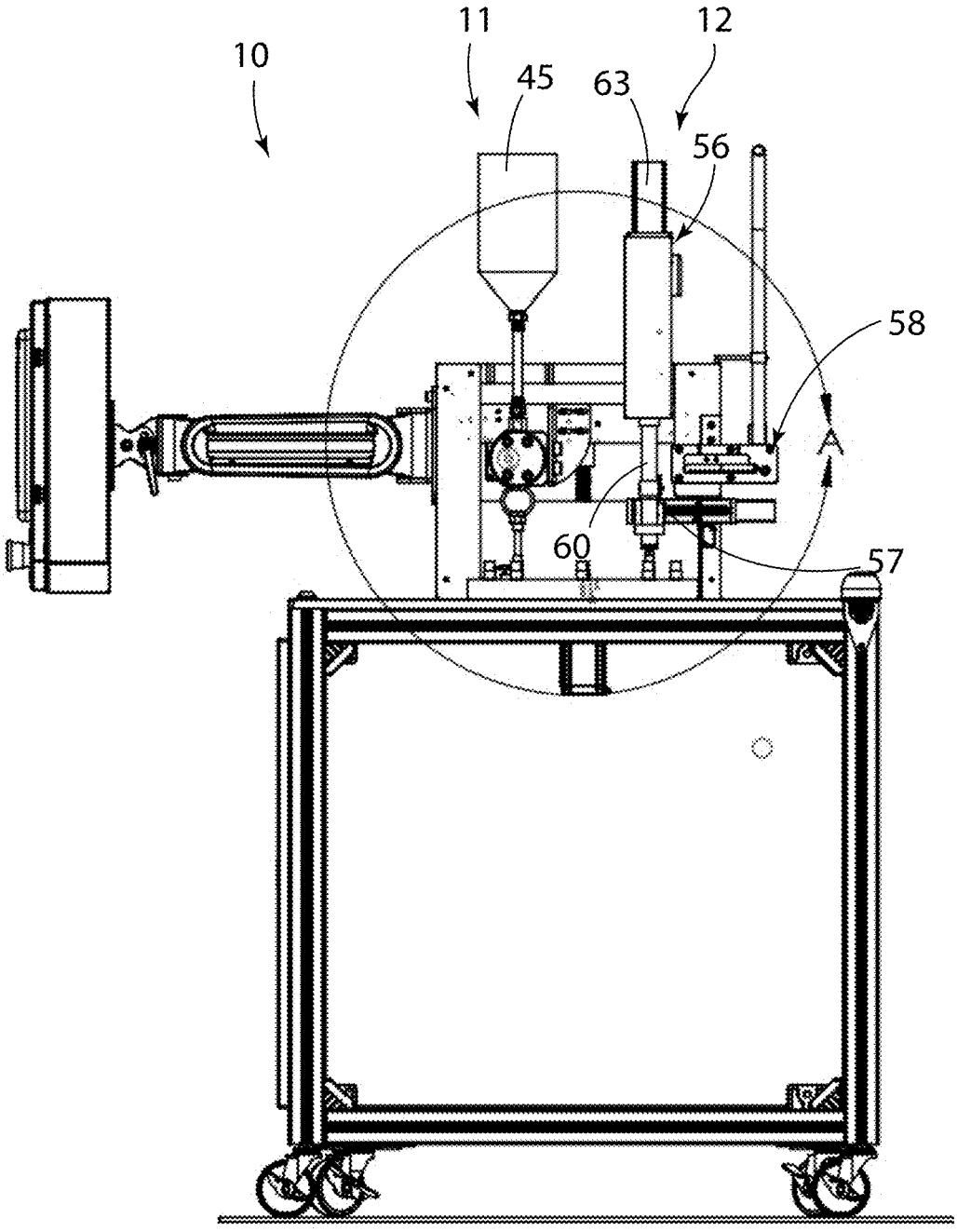
FIG. 10 is a front elevation view of the cartridge handling machine illustrating the filling module and capping module actuated to both fill an empty cartridge body and cap a filled cartridge body.

Referring to FIGS. 6A and 6B, the chuck 57 projects downwardly and has an upper end connected to a drive shaft 60, which is configured to be vertically movable by a linear actuator or drive unit 61 enclosed within a drive housing 62. By vertically shifting the drive shaft 60, the chuck 57 can reciprocate vertically, and drive the cap 22 downwardly during the capping operation. FIG. 6A shows the chuck 57 in the raised position and FIG. 10 shows the chuck 57 displaced to the lowered position for installing the cap 22 onto the cartridge body 14. The vertical reciprocation of the chuck 57 is preferably performed during both a press fit operation and a rotary operation when mounting the cap 22 to the cartridge body 14.

Additionally, some operations required that the cap 22 be rotated, such as when threading the cap 22 onto the cartridge body 14. As such, the drive shaft 60 may also be rotated about a vertical axis by a shaft motor 63 located at an upper end of the drive housing 62. To support the drive shaft 60, the drive shaft 60 may be slidably supported on a vertical guide 64, while still being rotatable when supported in this manner. Preferably, the capper assembly 56 is reconfigurable so that the drive shaft 60 only slides vertically during press fit operations, and slides vertically and rotates during screw fit type operations. The up and down movement and rotary motion of the drive shaft 60 can be independently controlled by selective operation of the linear actuator 61 and drive motor 63. The following disclosure provides additional details as to the operation of the chuck 57 in mounting the cap 22 to the cartridge body 14.

Figure 11:
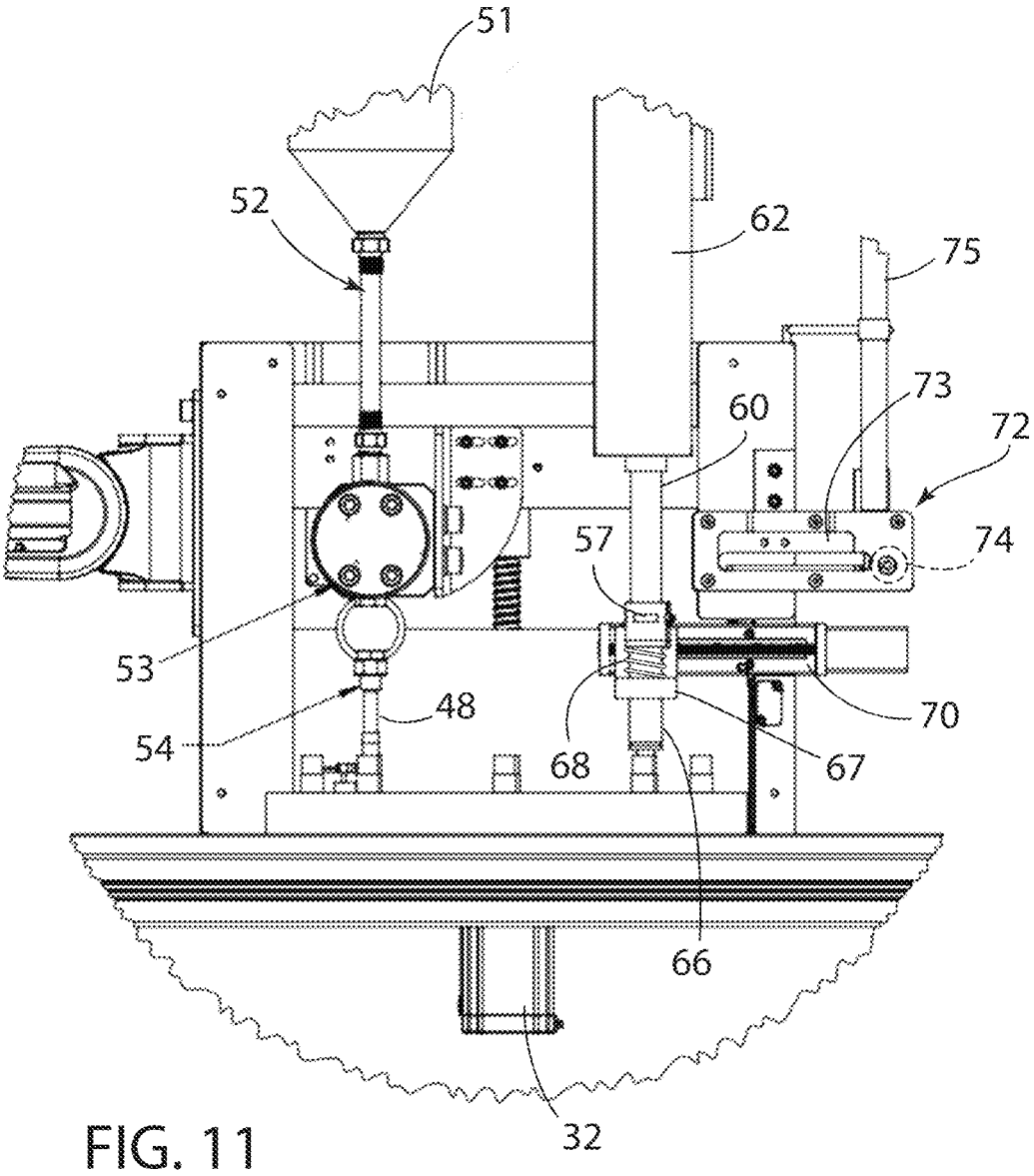
FIG. 11 is an enlarged front view illustrating the filling and capping modules and the heater units thereof.
Figure 12:
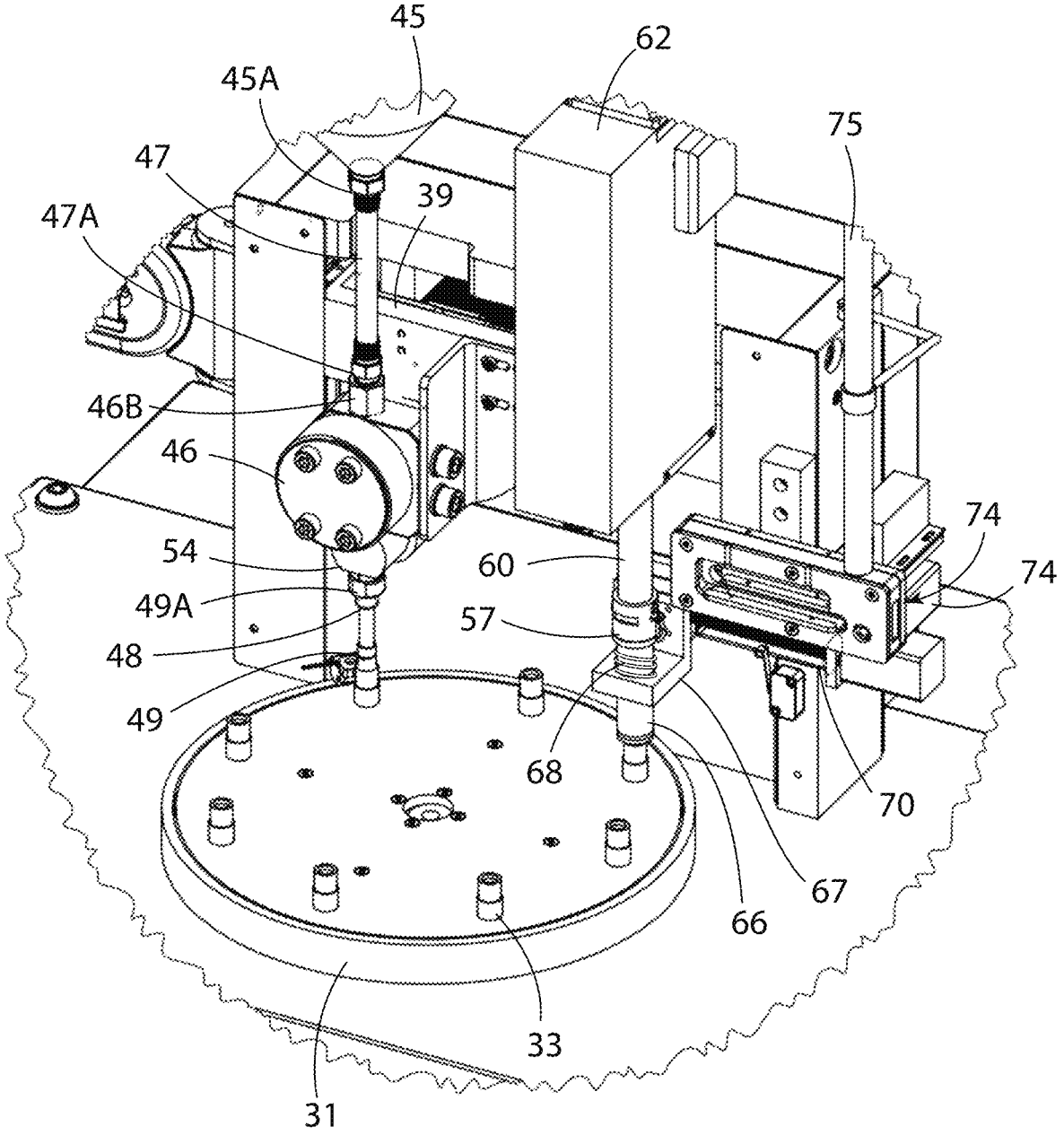
FIG. 12 is a partial right perspective view thereof.

Referring to FIGS. 6A, 9 and 11, the capping module 12 incorporates the inventive feed assembly 58 having a movable cap carrier 66 that moves between a rightward loading position (FIG. 6A) and a leftward capping position (FIG. 11). Generally, the carrier 66 transfers a cap 22 sidewardly to the chuck 57, wherein the chuck 57 drives the cap 22 downwardly out of the carrier 66 for capping the cartridge body 14.

The carrier 66 is formed as a generally hollow cylinder, which is vertically open to receive a cap 22 in the upper end and vertically discharge the cap 22 from a lower end. The carrier 66 is slidably supported in support flange 67 so that the carrier 66 can reciprocate vertically in the support flange 67. The carrier 66 is normally biased upwardly to an initial position by a biasing member such as a spring 68 as shown in FIGS. 6A and 9, wherein the spring 68 allows the carrier 66 to be pushed downwardly by the chuck 57 as shown in FIG. 11. Therefore, downward movement of the chuck 57 pushes the carrier 66 downwardly, and raising of the chuck 57 allows the carrier 66 to move upwardly in response to the spring 68.

The carrier 66 is also configured to reciprocate sidewardly between a loading position shown in FIG. 6A and a capping position shown in FIG. 11. In this regard, the feed assembly 58 comprises a horizontal guide track 70 which slidably supports the support flange 67 thereon. The support flange 67 is driven by an actuator 71 such as a screw drive or linear actuator that is operated by the control system to reciprocate the support flange 67 and carrier 66 sidewardly between the loading position and the capping position.

The feed assembly 58 also includes a cap loader 72, which includes a storage chamber 73 in which a horizontal stack of caps 22 is stored and a shifter unit 74 that is configured to drive the stack of caps 22 sidewardly to the left as caps 22 are fed one at a time to the carrier 66. As generally seen in FIG. 9, the shifter unit 74 may be a rotary drive that may have a rotatable cam that is driven by a shifter motor 74A (see FIG. 9) to incrementally shift the caps 22 one cap position to the left during loading and then clears a space within the storage chamber 73 to allow a replacement cap 22 to drop from a cap supply tube or unit 75 into the open space next to the shifter unit 74. The caps 22 are discharged from the left end of the cap loader 72 to the carrier 66, and are replaced on the right end next to the shifter unit 74. This right end of the cap loader 72 is fed with replacement caps 22 through the cap supply unit 75 that preferably is formed as a cap supply tube and is filled vertically with caps 22 through an upper end thereof.

In operation, the cap loader 72 incrementally loads the caps into the cap carrier 66, preferably by dropping the caps 22 one at a time into the carrier 66 as generally indicated by reference arrow 77 in FIG. 6A. The caps 22 drop into the open upper end of the carrier 66 and are held in an interior holding chamber 78 (described further relative to FIG. 32) in a temporary storage position. As described in more detail relative to FIG. 32, the interior chamber 78 may include a releasable stop 79 that stops and holds the caps 22 in the interior chamber 78 of the carrier, but releases the cap 22 when the chuck 57 engages the loaded cap 22, which releases the cap 22 from the stop 79 and drives the cap 22 out of the open bottom end of the holding chamber 78 for connection to the cartridge body 14.

In the loading position of FIG. 6A, the cap carrier 66 receives a cap 22 and holds same in the temporary storage position therein. The cap carrier 66 then displaces to the capping position shown in FIG. 11, which aligns the carrier 66 with the installation chuck 57, wherein the installation chuck 57 then displaces downwardly to drive the cap 22 from the storage position toward and into engagement with the cartridge body 14. As noted above, the chuck 57 may drive the cap 22 into press fit engagement, rotate the cap 22 into screwed or threaded engagement or may otherwise position or displace the cap 22 depending upon any other engagement means being provided. It will be understood that the term press fit will encompass both a tight-fitting interference fit, and a snap fit or other fastener fit wherein engagement results from axial displacement of the cap 22 toward the cartridge body 14. The screw fit or threaded fit may also be referenced as a rotary fit, which may also encompass other fastening means in which rotation effects fixing of the cap 22 on the cartridge body 14.

The caps 22 preferably are prepositioned in the cap loader 72 in a row extending between the left and right ends of the storage chamber 73 and are fed along the feed path by the shifter unit 74 such that the leftmost cap 22 is discharged from the left chamber end. In particular, the left chamber end has a bottom opening that allows the leftmost cap 22 to drop by gravity from the cap loader 72 into the carrier 66 when in the loading position (FIG. 6A). As the shifter unit 74 rotates at the right chamber end, a space is opened, which is restocked with another cap 22 from the cap supply unit 75. The loaded carrier 66 then cycles to the left to the capping position for unloading by the chuck 57. The cycle is repeated to incrementally and successively feed caps 22 one at a time to the carrier 66 each time the empty unloaded carrier 66 returns to the loading position. Feeding and discharge of the caps 22 is synchronized with the chuck movement and may also be synchronized with the conveyor movement and/or the nozzle fill movements so that continuous synchronous operation of the fill module 11 and capping module 12 occurs. Or, as noted above, the capping module 12 may be synchronized only with the conveyor module 29 if alternate filling means are provided. Preferably, the movements occur in a step-wise, start-stop movement wherein the conveyor module 29 stops for each filling and capping operation. Further, the fill module 11 and capping module 12 are located so that the filling and capping operations can occur simultaneously.

The inventive cartridge handling machine 10 and the individual filling and capping modules 11 and 12 thereof provide significant improvements and advantages over known machines used to fill cartridges with viscous consumable fluids comprising cannabis and/or CBD oil.

Figure 14:
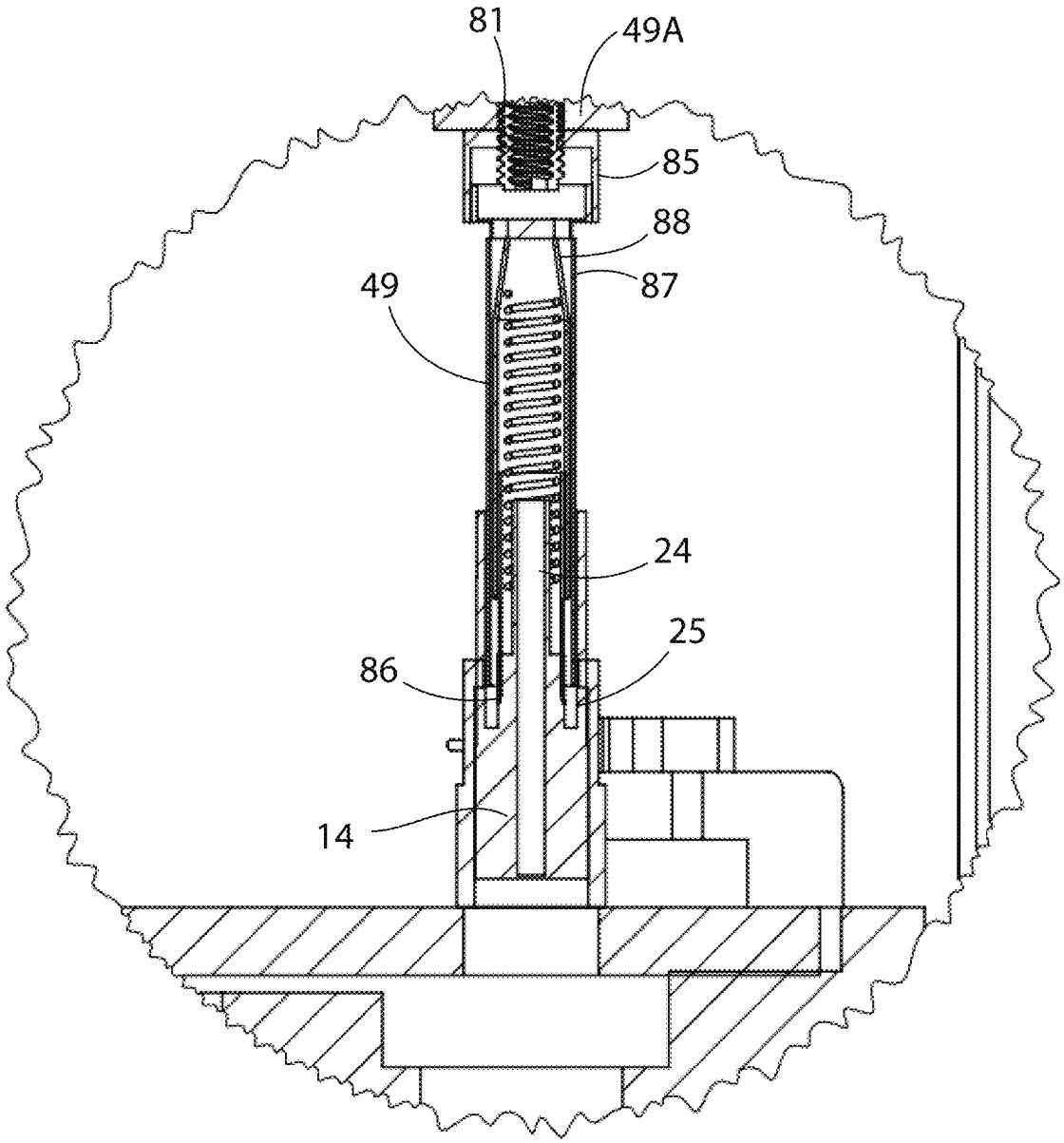
FIG. 14 is an enlarged side cross-section focused on the injector nozzle engaged with cartridge body.

The following next provides a more detailed description of the individual features of the injector nozzle 49, chuck 57 and the operation thereof. FIG. 13 is a right side cross sectional view as taken through the filling module 11 with the injector nozzle 49 engaged with a cartridge body 14, wherein FIG. 14 is an enlarged side cross-section focused on the injector nozzle 49 and cartridge body 14. The injector nozzle 49 is configured as a precision feed nozzle that provides a fill accuracy within ±0.02 ml of the desired fill volume.

The injector nozzle 49 receives the fill fluid from the storage tank or hopper 45 through the heated passages defined through the hollow standpipe 47, pump 46 and the pump passages thereof, the heater 54 and heater passages thereof, and the downstream fitting 49A, which provides rigid support to the injector nozzle 49. The injector nozzle 49 is joined to the fitting 49A through a hollow screw connector 81, and the heater 46 connects to the pump 46 through threaded fitting 46A Additional fittings 46B, 47A and 45A are provided to join this assembly of components together. Notably, all fittings and components of the filling module 11 define a continuous flow path for the fill fluid and may be disassembled for cleaning, which is needed when the fill fluid is an oil based fluid such as viscous cannabis or hemp based oils. Cleaning may be required between batches of fill fluids or when switching types of fill fluids.

For operation, the pump 46 is driven by a pump motor 82 through an intermediate motor shaft 83, wherein the pump motor 82 is preferably a stepper motor to provide precision driving of the pump 46. The pump 46 draws fill fluid from the upstream storage tank 45, and supplies fill fluid under pressure to the injection assembly 48 when the injector nozzle 49 is shifted downwardly and seats on the cartridge body 14 as shown in FIG. 13.

Figure 21:
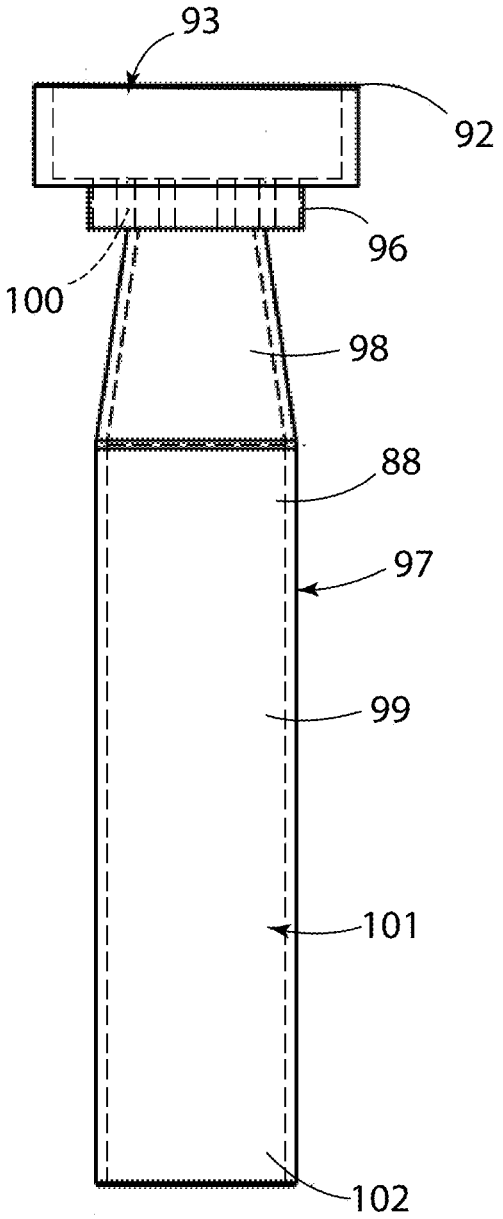
FIGS. 21 and 22 are front and top views of an interior injector body defining interior fluid feed passages within the injector nozzle.
Figure 22:
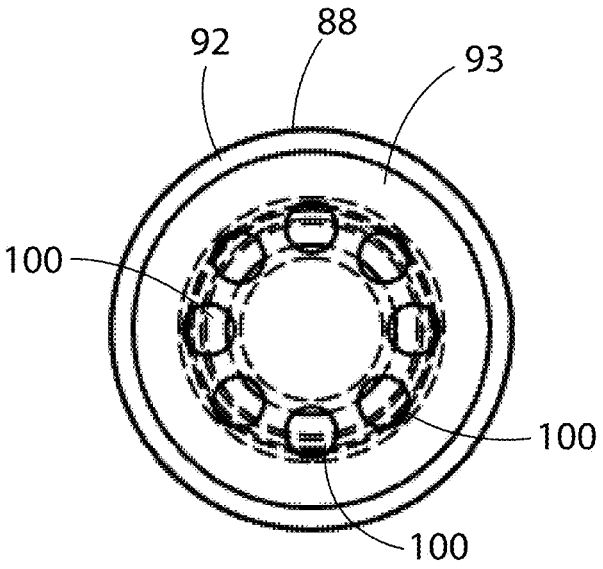

FIG. 14 shows an enlarged view of the injector nozzle 49 while FIGS. 15-20 show the separate components thereof, wherein: FIGS. 15 and 16 are front elevation and perspective views of the injector nozzle 49 assembled together; FIGS. 17 and 18 are top and front views of an injector head 85; FIG. 19 is a front elevation view of an end mouthpiece 86 for the nozzle 49; and FIG. 20 is a front elevation view of an injector housing 87. Further, FIGS. 21 and 22 are front and top views of an interior body 88 defining interior fluid feed passages within the injector nozzle 49.

Figure 23:
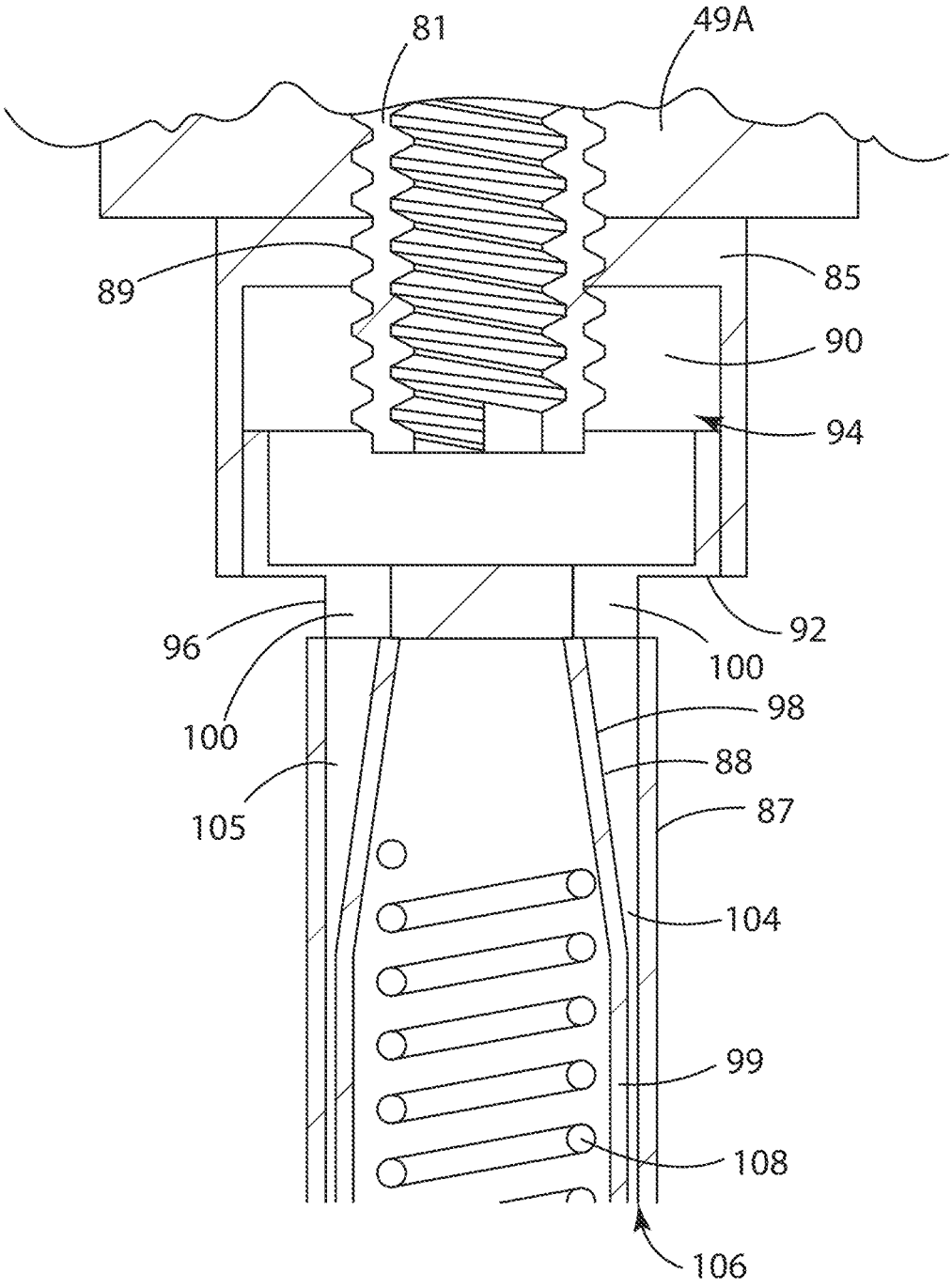
FIG. 23 is an enlarged partial cross-sectional view of the upper end portion of the injector nozzle mounted to a heater.
Figure 24:
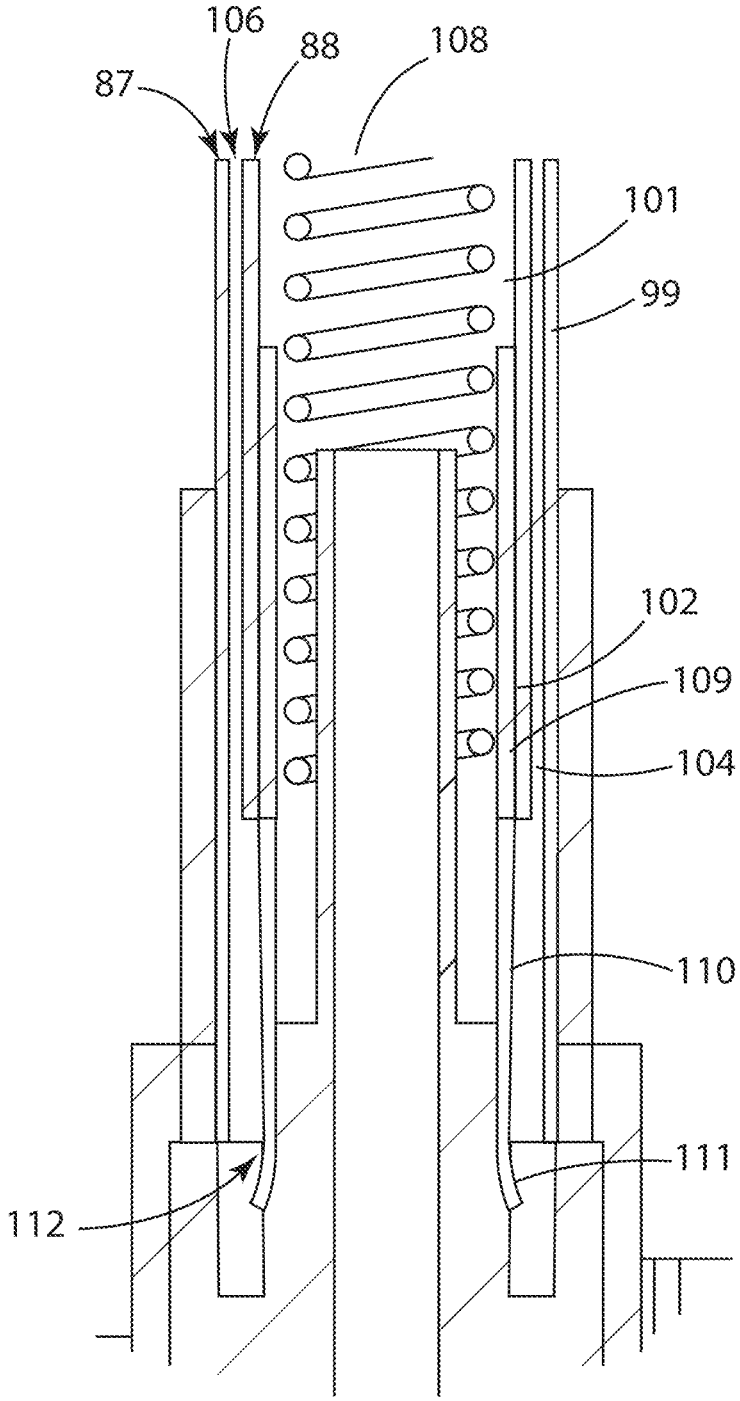
FIG. 24 is an enlarged partial cross-sectional view of the lower end portion of the injector nozzle engaged with a cartridge body for filling thereof.

In more detail, FIG. 23 is an enlarged partial cross-sectional view of the upper end portion of the injector nozzle 49 mounted to the heater 46 through the fitting 49A and coupler 81. Further, FIG. 24 is an enlarged partial cross-sectional view of the lower end portion of the injector nozzle 49 engaged with the cartridge body 14 for filling thereof. A description of the assembly of such components follows below.

The upper end of the injector nozzle 49 is enclosed by the injector head 85, which has an open cup-shape defined by a side wall and end wall. The end wall has a threaded bore 89 coupled to the coupler 81 for mounting to the fitting 49A. As such, the injector nozzle 49 is removable for cleaning. The injector head 85 defines a downward opening head chamber 90, which receives an upper end of the interior body 88 therein.

The interior body 88 is formed with an upper collar 92 that fits within the head chamber 90 and forms an upward opening collar chamber 93 that is in open communication with the head chamber 90. As seen in FIG. 23, the upper collar 92 fits within the interior of the head chamber 90, wherein the head chamber 90 and collar chamber 93 form main fluid chamber 94 that is supplied with pressurized fill fluid through the hollow coupler 81.

The bottom wall of the upper collar 92 is configured with a distribution plate 96 that supports a tapered interior wall 97 extending downwardly therefrom. The interior wall 97 has a tapered section 98 and a cylindrical section 99. The distribution plate 96 is formed with an array of distribution ports 100, which are circumferentially spaced apart from each along a common circle. The distribution ports 100 are disposed radially outwardly of the narrowest portion of the tapered section 98 so that the distribution ports 100 allow fluid flow from the collar chamber 93 to an exterior of the tapered section 98 and the cylindrical section 99. The interior of the interior wall 97 is open at the bottom to define an interior space 101 that has an open bottom 102 but is closed off from the collar chamber 93 by the distribution plate 96. Therefore, fill fluid flows from the collar chamber 93 to the exterior of the wall 97 in an annular pattern extending 360 degrees about the outer periphery of the wall 97.

The interior body 88 is surrounded by the injector housing 87, which is supported thereon. The injector housing 87 is spaced radially outwardly of the interior wall 97 to define an annular injection passage 104, which comprises a radially enlarged inlet section 105 surrounding the tapered wall section 98 and a narrower outlet section 106 surrounding the cylindrical wall section 99. The inlet section 105 receives fluid annularly throughout its 360 degree circumference from the distribution ports 100. The outlet section 106 defines an annular flow path that has a circular pattern through which fluid flows downwardly toward the cartridge body 14.

Referring to FIG. 24, the open bottom 102 of the interior body 88 slidably receives the cylindrical mouthpiece 86 therein, which is spring biased by an interior spring 108. The mouthpiece 86 has a wider support section 109, which fits closely and slides within the open bottom 102, and has a narrower discharge section 110 formed with a flared rim 111.

The discharge section 110 is spaced radially inwardly of the outer housing 87 to define an annular injection outlet 112 configured to inject fill fluid into the cartridge body 14. When the cartridge body 14 reaches the fill position in the filling station 34, the mouthpiece 86 and its discharge section 110 engages cartridge body 14, wherein the annular injection outlet 112 generally aligns with and opens into the open mouth 28 of the cartridge body 14 so as to inject the consumable fluid therein. In the inventive injector nozzle 49, the injection outlet 112 is formed as an annular injector passage or port, through which the fluid is discharged. The central portion of the injector nozzle 49 in the region of the hollow interior 101 is dead space which is separated from the injection outlet or injector passage 112 by the interior wall 97 and mouthpiece 86 and does not dispense the fluid. The annular injection outlet or injector passage 112 forms an annular pattern of fluid discharge, preferably shaped in a circle extending throughout 360 degrees to provide for uniform, annular filling of the cartridge chamber.

In this configuration, air may be displaced out of the cartridge body 14 and may escape back to the injection outlet 112 or through the central portion of the injector nozzle, which essentially forms a discharge passage or port for discharge of air from the cartridge body. This prevents the formation of air pockets or bubbles within the cartridge body 14 during the filling step.

The injector nozzle 49 engages with the annular mouth 28 in a generally sealed relation so that pressurized fluid is injected into the cartridge mouth 28, wherein the 360 degree or annular injection pattern and pressurized fluid also facilitates priming of the cartridge wick of the atomizer or heater preinstalled within the cartridge body 14. This provides significant advantages over known cartridge filling devices.

Figure 25A:
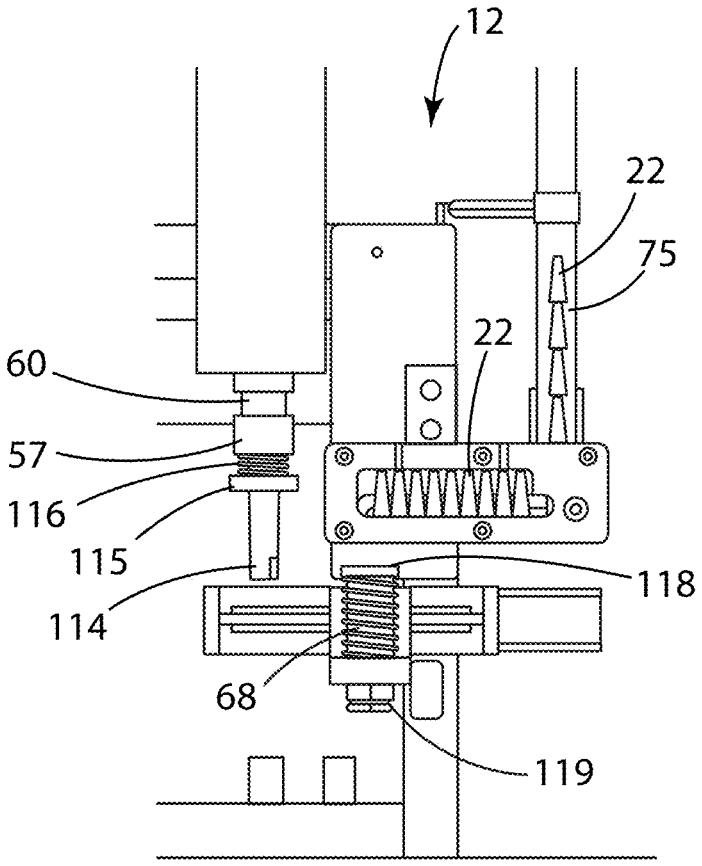
FIG. 25A is an enlarged partial front view of the capping module in an initial position.
Figure 25B:
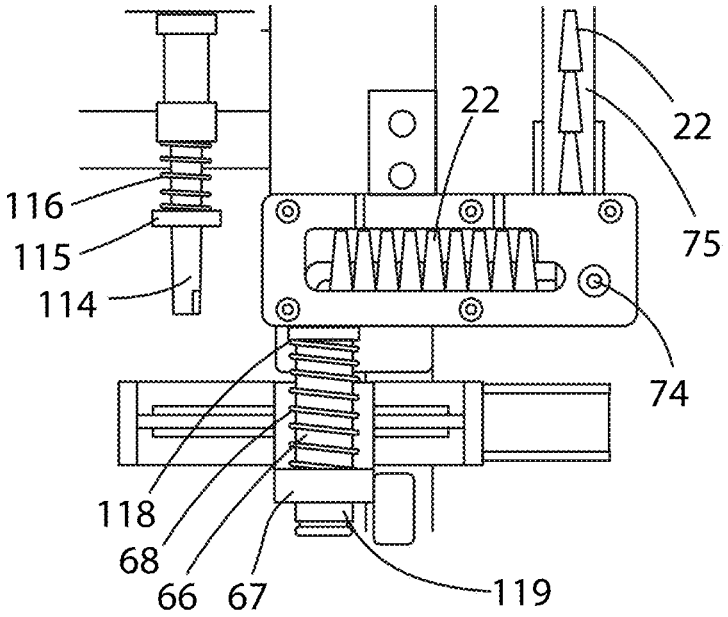
FIG. 25B is an enlarged partial perspective view of the capping module in an initial position.

FIG. 25A is an enlarged partial front view of the capping module 12 in an initial position with the chuck 57 in a raised position and the carrier 66 in the rightward loading position, wherein FIG. 25B shows a partial perspective view of the capping module 12.

As described above, the chuck 57 projects downwardly and has an upper end connected to the drive shaft 60. By vertically shifting the drive shaft 60, the chuck 57 can reciprocate vertically, and drive the cap 22 downwardly during the capping operation. Additionally, some operations required that the cap 22 be rotated, such as when threading the cap 22 onto the cartridge body 14. In the illustrated embodiment, the chuck 57 may have drive formations 114 that facilitate rotative driving of the cap 22. The chuck 57 may also omit such drive formations 114 and instead be formed with a relatively flat friction surface for contacting the top surface of the cap 22 and rotating the cap 22 by frictional contact of the opposing surfaces.

As seen in FIGS. 25A and 25B, the chuck 57 further comprises a chuck collar 115 that is vertically slidable along the chuck body and is fixed to the chuck 57 by a biasing member such as spring 116. Generally, spring 116 prevents or restrains rotation of the chuck collar 115 relative to the chuck body so that the chuck collar 115 rotates with the chuck 57.

Figure 26:
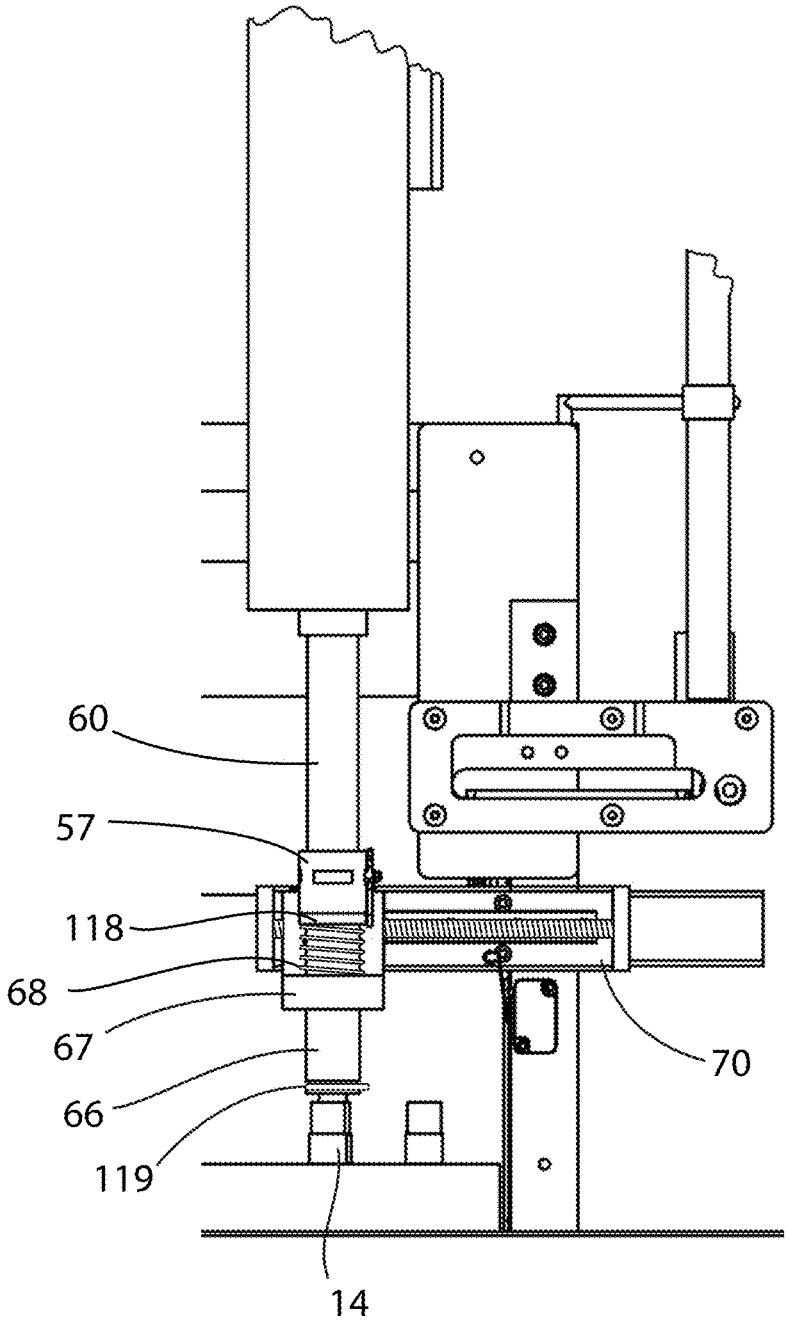
FIG. 26 is an enlarged partial front view of the capping module actuated to a loading position for mounting a cap to the filled cartridge body.

As to the carrier 66, the carrier 66 is shown in the rightward loading position but is movable to the leftward loading position of FIG. 26. As described above, the carrier 66 transfers the cap 22 sidewardly to the chuck 57, wherein the chuck 57 drives the cap 22 downwardly out of the carrier 66 for capping the cartridge body 14. Further, the carrier 66 is formed as a generally hollow cylinder, which receives the cap 22 in the upper end and vertically discharges the cap 22 from the lower end. The carrier 66 is slidably supported in support flange 67 so that the carrier 66 can reciprocate vertically in the support flange 67. The carrier 66 essentially has a cylindrical outer surface that conforms to a circular bore 117 (see FIG. 27) in the support flange 67. As such, the carrier 66 is vertically slidable through the bore 117 and is biased to the raised position by the spring 68. To confine the carrier 66 vertically within the flange bore, the upper rim 118 of the carrier 66 is radially enlarged while the bottom rim 119 includes a fastener such as a snap ring so that the carrier 66 cannot be removed from bore 117 during operation.

The carrier 66 can also rotate within the bore 117 of the support flange 117. For a screw fit operation, the chuck 57 rotates, wherein the chuck collar 115 moves down and contacts the upper rim 118 of the carrier 66 and thereby initiates a corresponding rotation of the carrier 66 by frictional contact between the chuck collar 115 and rim 118 during the capping operation.

Figure 27:
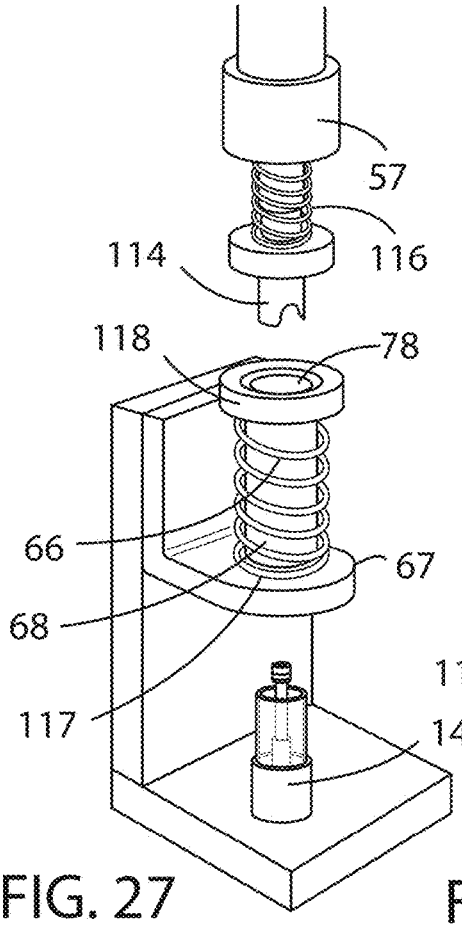
FIG. 27 is a partial perspective view of a first capping step with an installation chuck located above a cap carrier, which is loaded with a cap and positioned above the filled cartridge body in a loading position.
Figure 28:
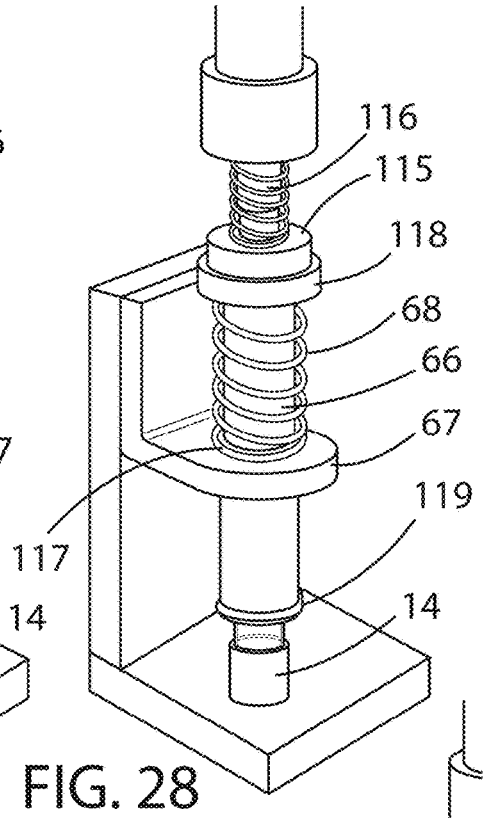
FIG. 28 is a partial perspective view of a second capping step with the chuck displaced downwardly into the carrier for driving engagement with the loaded cap in the carrier.

To illustrate the capping operation in greater detail, FIG. 26 is an enlarged partial front view of the carrier 66 actuated to a loading position for mounting a cap 22 to the filled cartridge body 14, wherein the chuck 57 is partially engaged with the carrier bore 78. In more detail, FIG. 27 is a partial perspective view of a first capping step with the installation chuck 57 located above a cap carrier 66, which is loaded with a cap 22 and positioned above the filled cartridge body 66 in a loading position. For this screw fit configuration, the chuck 57 rotates and displaces downwardly so that the chuck 57 enters the carrier bore 78, wherein FIG. 28 is a partial perspective view of a second capping step with the chuck 57 displaced downwardly into the carrier 66 for driving engagement with the loaded cap 22 in the carrier 66. In this second step, the drive formations 114 are engaging with the cap 22 and pushing the cap 22 past the stops 79 (shown in FIG. 32). At this step, the chuck collar 115 rotates with the chuck 57 and then contacts the upper rim 118 of the carrier 66 to initiate rotation of the carrier 66 along with the cap 22. The carrier 66 has begun to travel downwardly toward the filled cartridge body 14.

Figure 29:
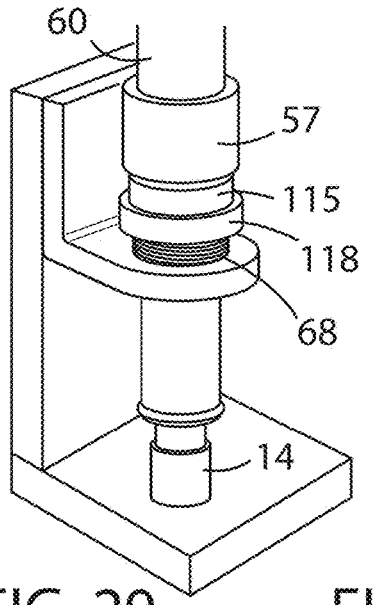
FIG. 29 is a partial perspective view of a third capping step with the chuck displaced downwardly and in turn driving the carrier downwardly to seat the loaded cap on the cartridge body.

Next, FIG. 29 is a partial perspective view of a third capping step with the chuck 57 displaced downwardly and in turn driving the carrier 66 downwardly to seat the loaded cap 22 on the cartridge body 14. At this step, both springs 116 and 68 are fully compressed.

Figure 30:
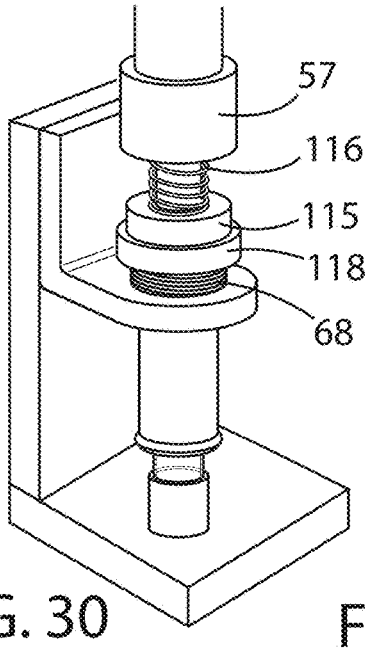
FIG. 30 is a partial perspective view of a fourth capping step after the cap is mounted on the cartridge body with the chuck returning upwardly while maintaining the carrier against the capped cartridge body.

FIG. 30 is a partial perspective view of a fourth capping step after the cap 22 is mounted on the cartridge body 14 with the chuck 57 returning upwardly while maintaining the carrier 66 against the capped cartridge body 14. The chuck spring 115 has begun to expand as the chuck 57 separates from the cartridge body 14.

Figure 31:
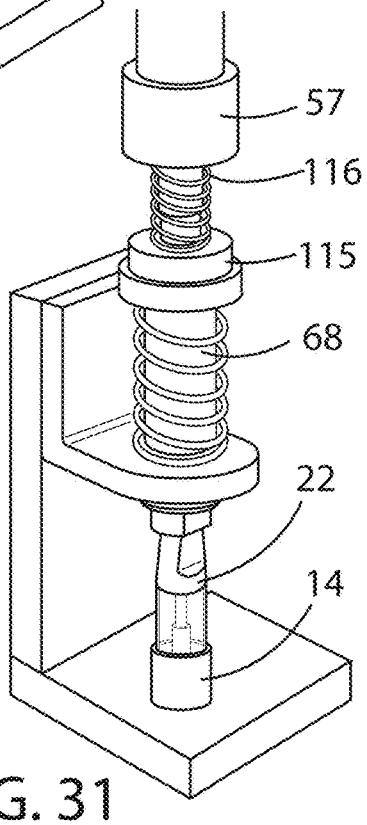
FIG. 31 is a partial perspective of a fifth capping step with the chuck and carrier moving upwardly and disengaging from the capped cartridge body.

FIG. 31 is a partial perspective of a fifth capping step with the chuck 57 and carrier 66 moving upwardly and disengaging from the capped cartridge body 14. Both springs 115 and 68 have expanded and the chuck 57 will eventually separate as it continues rising.

Figure 32:
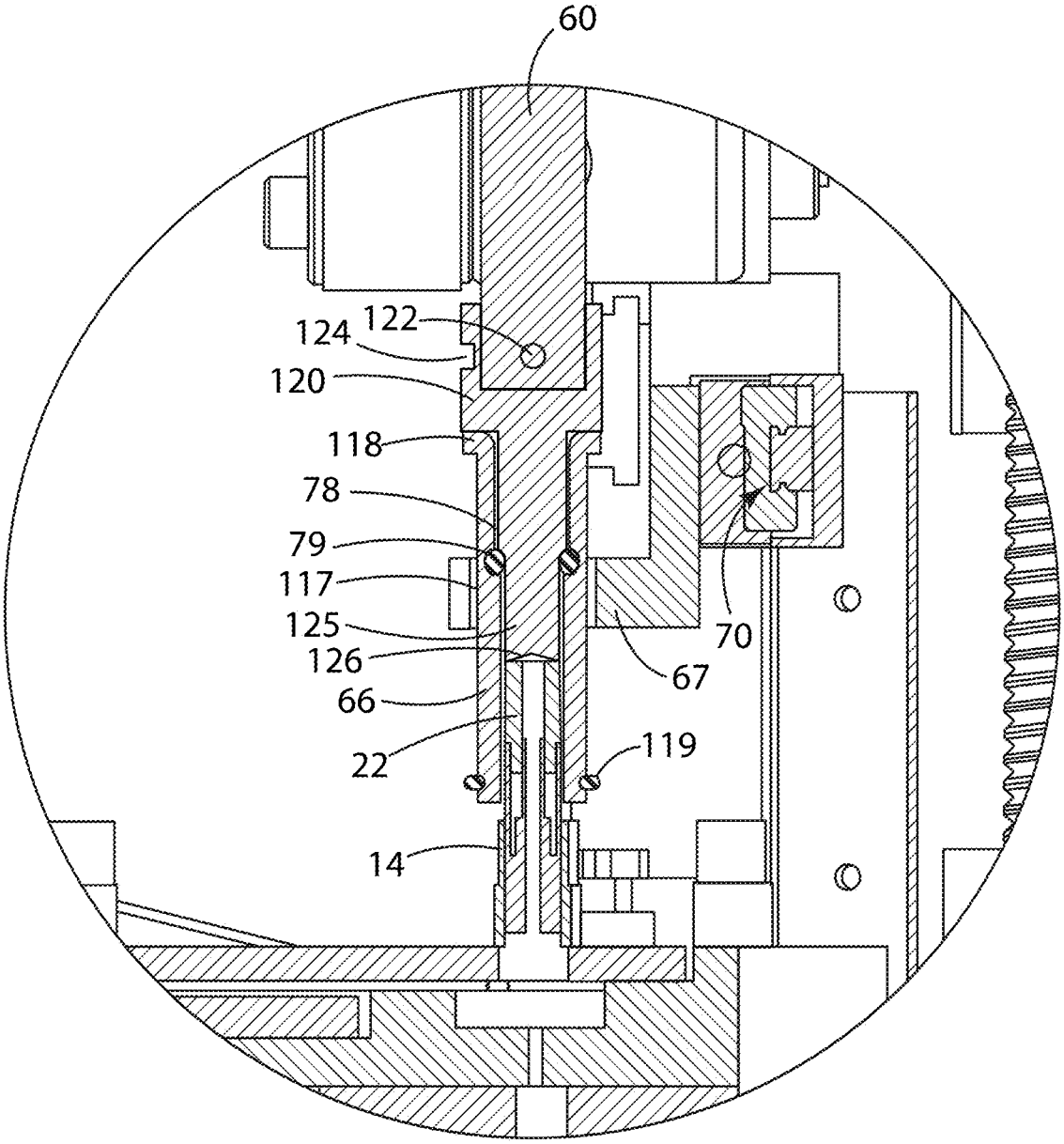
FIG. 32 is an enlarged cross sectional view of a press fit embodiment of the capping machine illustrating the chuck pressing the cap onto the filled cartridge body.
Figure 33:
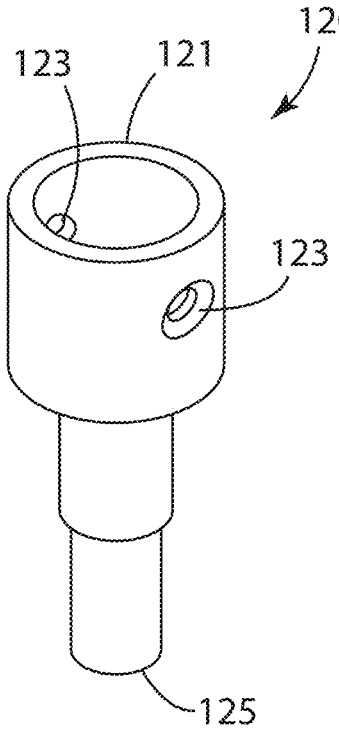
FIG. 33 is a perspective view of a chuck head for the press-fit chuck.
Figure 34:
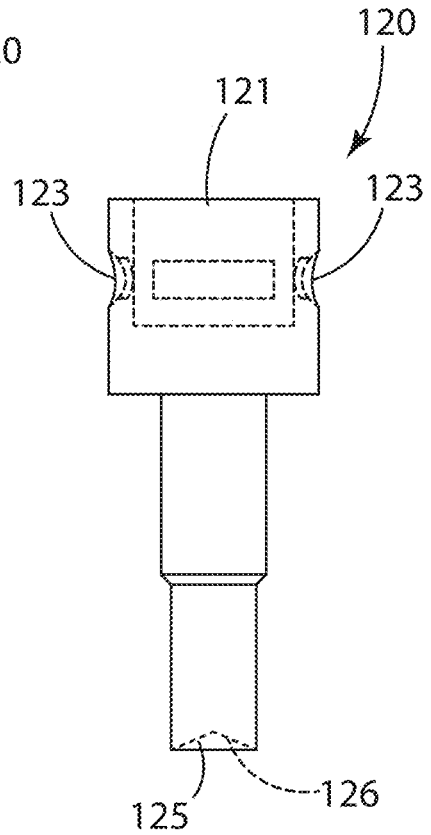
FIG. 34 is a front view thereof.
Figure 35:
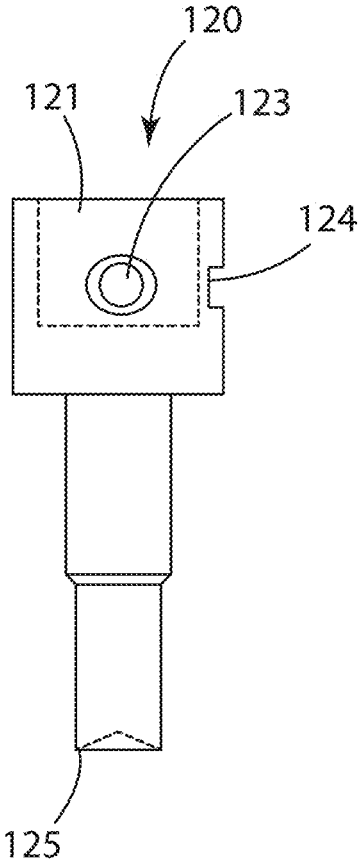
FIG. 35 is a side view thereof.

In further detail as to the chuck 57, FIGS. 32-35 illustrate a chuck 57 configured as a press fit chuck designated by reference numeral 120 in these figures. The press fit chuck 120 includes an upper mounting head 121 that is friction fitted onto the end of the shaft 60 and pinned in place by a pin 122 extending through pin bores 123. An additional notch 124 is located on one side. The press fit chuck 120 has a lower drive end 125 with a conical recess 126 that facilitates pressing contact with the upper end of the cap 22. FIG. 32 shows the press fit chuck 120 driven vertically into the carrier bore 78 to thereby drive the cap 22 downwardly past the stop or stop formation 79 and then press fit the cap 22 onto the cartridge body 14. As one example, the stop formation 79 can be a formation or other interfering structure that holds the cap 22 in the carrier bore 78 after loading but releases to allow the cap 22 to be driven down and out of the bore 78.

Figure 36:
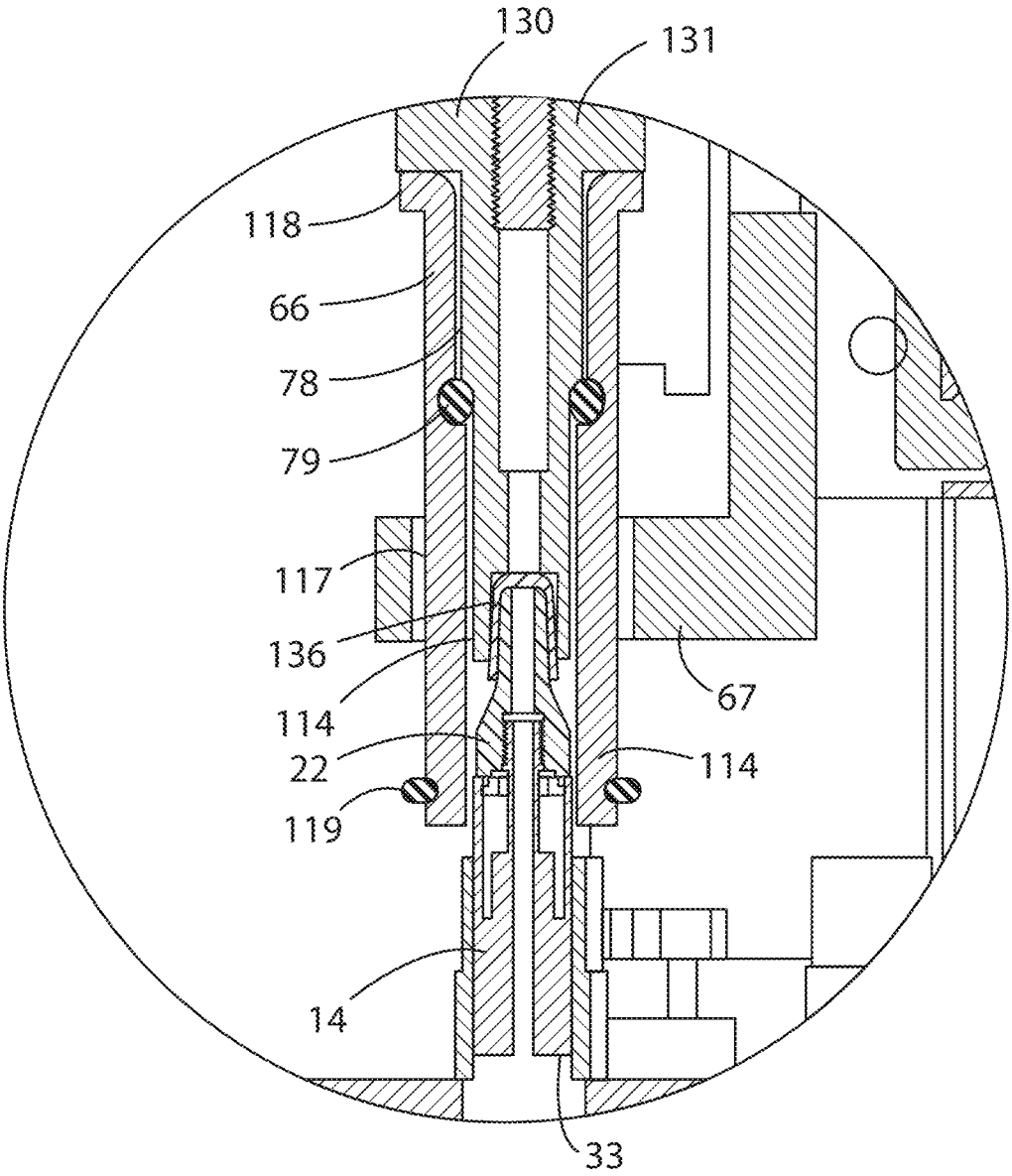
FIG. 36 is an enlarged cross sectional view of a screw fit embodiment of the capping machine illustrating the chuck threading or screwing the cap onto the filled cartridge body.
Figure 38A:
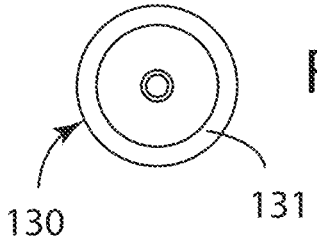
FIGS. 38A-C are top, front and bottom views thereof.
Figure 38B:
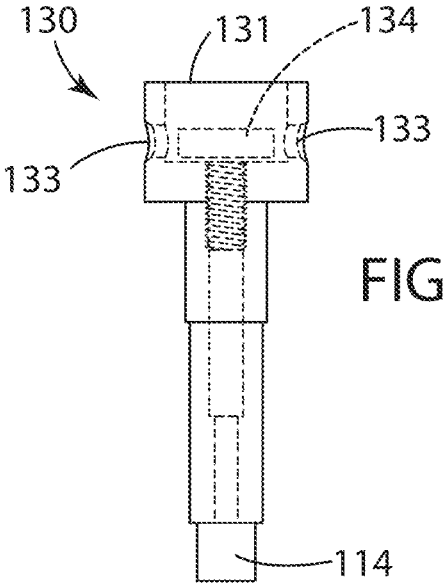
Figure 38C:
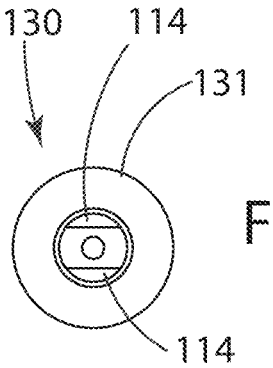
Figure 37:
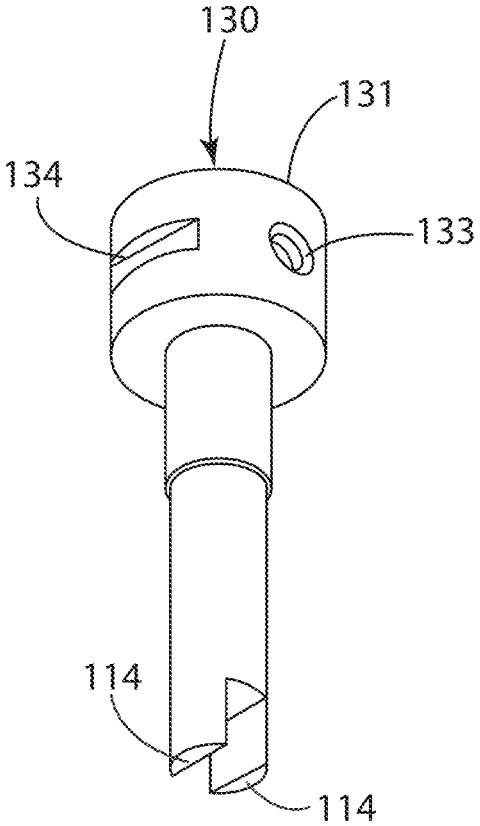
FIG. 37 is a perspective view of a chuck head for the screw-fit chuck.

In further detail as to the chuck 57 when configured as a rotary driver, FIGS. 36-38A-C illustrate a chuck 57 configured as a screw or rotary fit chuck designated by reference numeral 130 in these figures. The rotary fit chuck 130 includes an upper mounting head 131 that is friction fitted onto the end of the shaft 60 and pinned in place by a pin extending through pin bores 133. An additional notch 134 is located on one side. The rotary fit chuck 130 has a lower drive end 135 with the forked drive formations 114 that facilitates rotation of the upper end of the cap 22. FIG. 36 shows the rotary fit chuck 130 driven vertically into the carrier bore 78 to thereby drive the cap 22 downwardly past the stop or stop formation 79 and then mate with the upper end of the cap 22. This cap 22 also includes a mouthpiece cover 136 fitted onto the cap 22, which is generally narrow in one direction and wider in the perpendicular direction. The drive formations 114 have a fork shape with the drive formations 114 separated so as to fit the cap 22 and its mouthpiece cover 136 therebetween. Once mated together, the cap 22 is rotated by rotation of the rotary fit chuck 130. In this illustration, the cap 22 has already been driven down past the stop formation 79 and threaded or screwed onto the cartridge body 14. Notably, the cartridge body 14 is free to rotate within the turntable socket 33.

Figure 39:
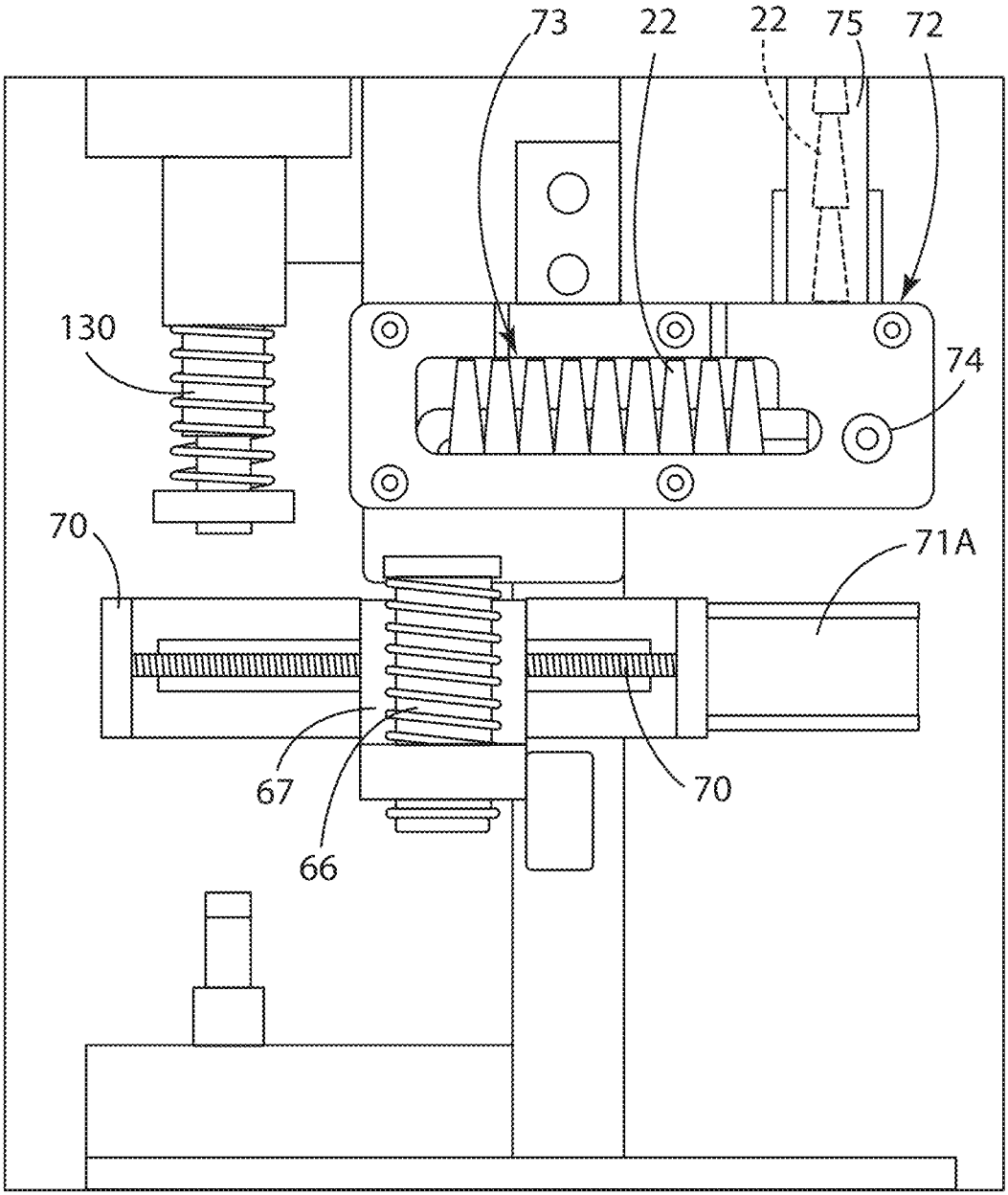
FIG. 39 is a partial perspective view of a first loading step with the carrier in an initial loading position adjacent a feed assembly for loading of a cap into the carrier.

To illustrate the capping operation using the rotary fit chuck 130, FIGS. 39-42 depict the operative steps during the capping and loading operations. FIG. 39 is a partial perspective view of a first loading step with the carrier 66 in an initial loading position adjacent the feed assembly 58 for loading of a cap 22 into the carrier. The feed assembly 58 includes the cap loader 72, which includes the storage chamber 73 in which the horizontal stack of caps 22 is seen therein.

Figure 40:
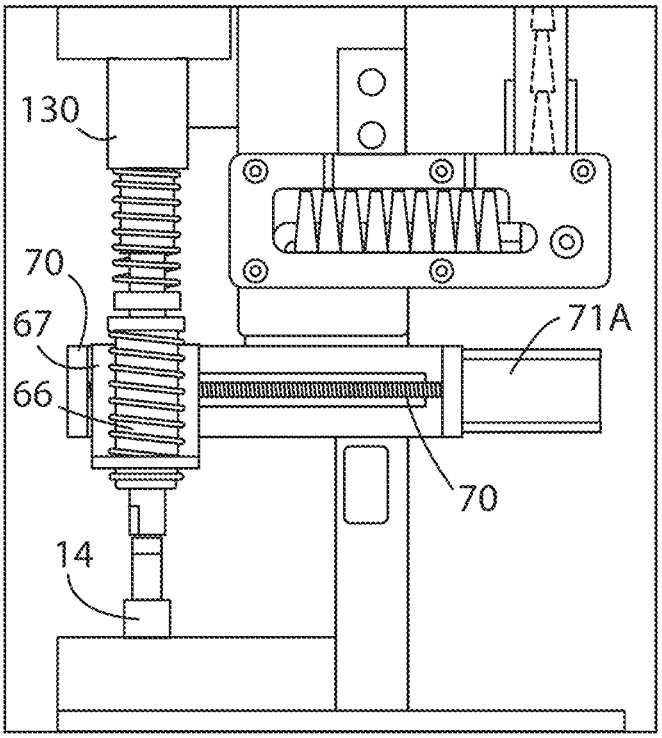
FIG. 40 is a partial perspective view of a second positioning step with the carrier displaced to a capping position corresponding to FIG. 27 above.

FIG. 40 is a partial perspective view of a second positioning step with the carrier 66 displaced to the capping position, which aligns the carrier 66 with the installation chuck 130, wherein the installation chuck 130 then displaces downwardly to drive the cap 22 from the storage position toward the cartridge body 14. In this regard, the horizontal guide track 70 slidably supports the support flange 67 and carrier 66. The support flange 67 is driven by an actuator 71 such as a screw drive that is driven by a motor 71A operated by the control system to reciprocate the support flange 67 and carrier 66 sidewardly between the loading position and the capping position.

Figure 41:
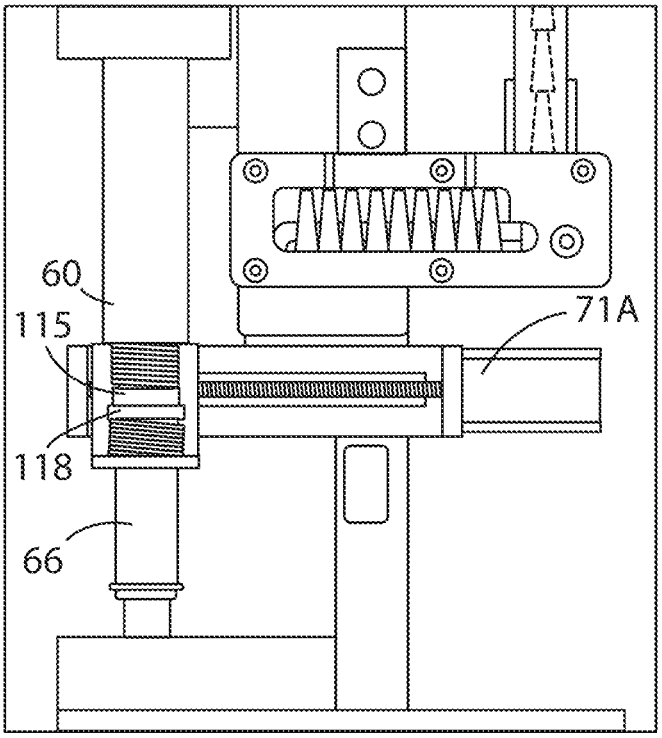
FIG. 41 is a partial perspective view of a third capping step with the chuck displaced down to the capping position corresponding to FIG. 30 above.

FIG. 41 is a partial perspective view of a third capping step with the chuck 130 displaced down to the capping position corresponding to FIG. 30 above for screwing the cap 22 onto the cartridge body 14.

Figure 42:
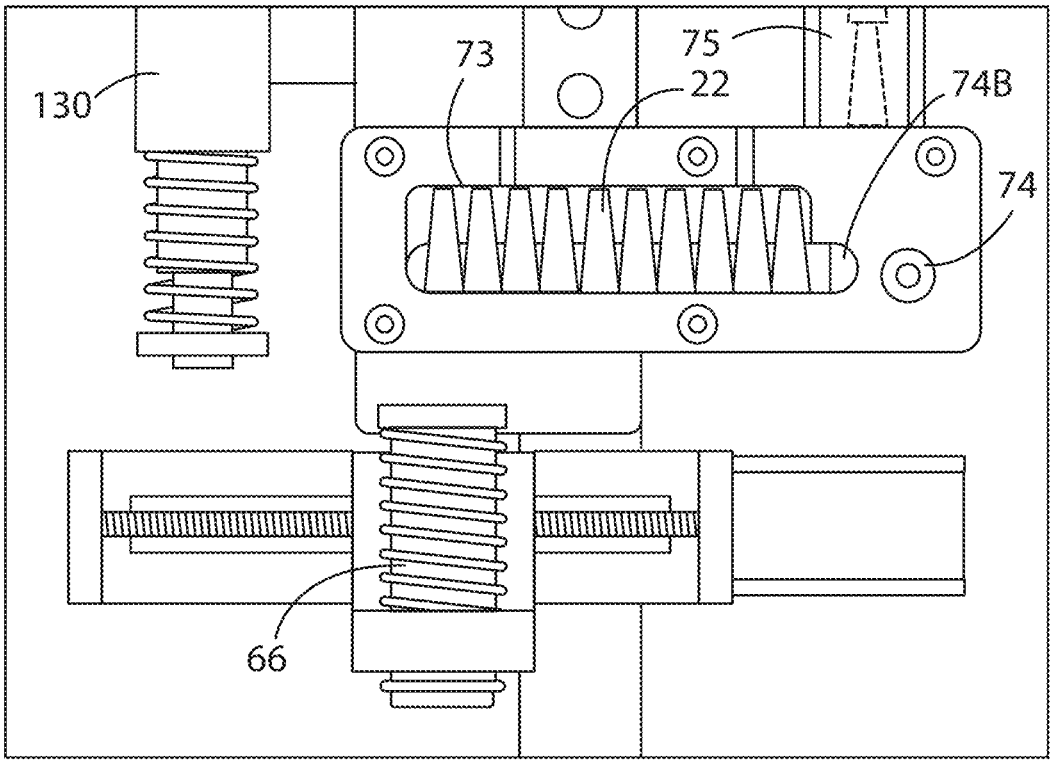
FIG. 42 is a partial perspective view of a fourth return step with the carrier returned to the loading position and a cam shifter actuated to incrementally displace a stock of caps and feed a next cap into the carrier.

FIG. 42 is a partial perspective view of a fourth return step with the carrier 66 returned to the loading position and the motor-driven cam shifter 74 actuated to incrementally displace a stock of caps 22 and feed a next cap 22 into the carrier 66. As generally seen in FIG. 9, the shifter unit 74 may be a rotary drive that may have a rotatable cam 74B that is driven by the shifter motor 74A to incrementally shift the caps 22 one cap position to the left during loading and then clears a space within the storage chamber 73 to allow a replacement cap 22 to drop from a cap supply tube or unit 75 into the open space next to the shifter unit 74. The caps 22 are discharged from the left end of the cap loader 72 to the carrier 66, and are replaced on the right end next to the shifter unit 74. This right end of the cap loader 72 is fed with replacement caps 22 through the cap supply unit 75.

Referring to FIGS. 43-59, an alternate embodiment of a nozzle assembly 148 with an injector nozzle 149 is illustrated, which provides for improved injection of viscous liquids. The nozzle assembly 148 is also configured for self-cleaning as described below relative to FIGS. 60-62.

The nozzle assembly 148 and injector nozzle 149 operate in conjunction with the above-described storage tank 45 and pump 46, wherein the injector nozzle 149 essentially replaces the nozzle 49 in the injector assembly 48 so as to be mounted together on the movable carriage 39. In the same manner as described above, the injector nozzle 149 can be moved downward into sealing engagement with the cartridge mouth 28 for filling of the cartridge body 14 as described further herein. Here again, the carriage 39 is reversible for raising and disengaging the injector nozzle 149 once the cartridge body 14 is filled. All of such components preferably may move together on the carriage 39 so that the distance between the storage tank 45 and injector nozzle 149 essentially remains fixed and the heater units 51, 52, 53 and 54 can provide uniform, controllable heat to these components and the fluid flowing therethrough. Additional heating is provided in the injector nozzle 149 by a nozzle heater unit 150 (FIGS. 43 and 44) as described further.

Figure 43:
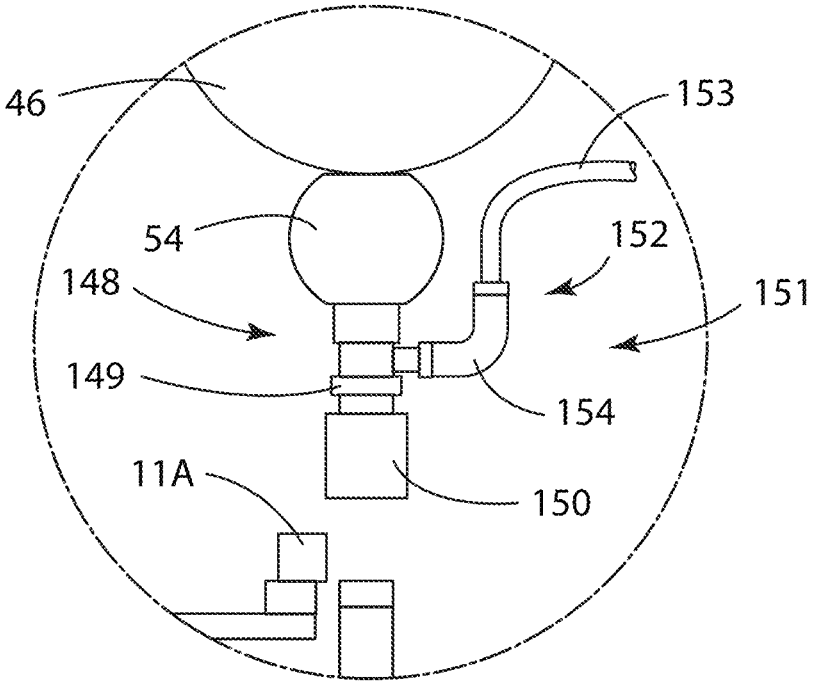
FIG. 43 is a partial perspective view of the filling module with an alternate injector assembly.
Figure 44:
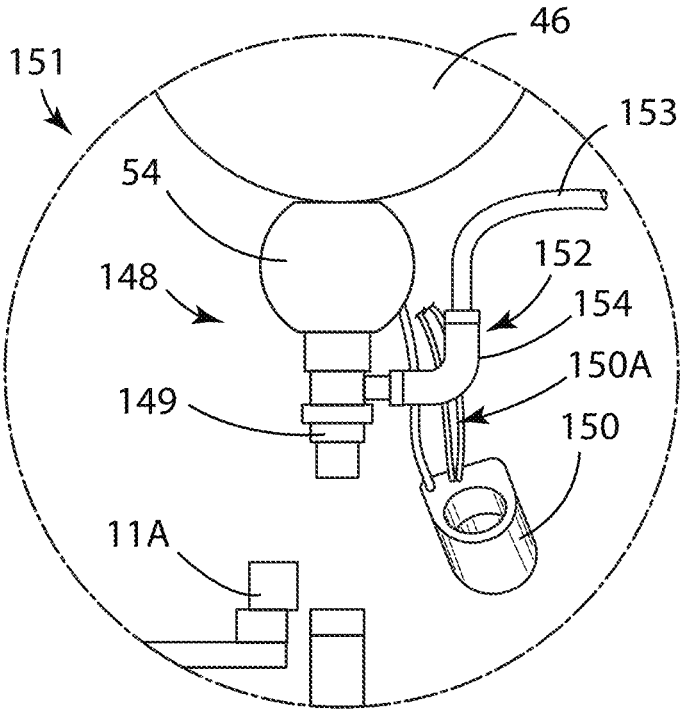
FIG. 44 is a partial perspective view of the filling module of FIG. 43 with a nozzle heater separated from the injector assembly.

In more detail, FIG. 43 is a partial perspective view of a filling module 151 with an alternate injector assembly 148, and FIG. 44 is a partial perspective view of the filling module 151 of FIG. 43 with a nozzle heater unit 150 separated from the injector assembly 148. The nozzle heater unit 150 is generally cylindrical so as to define a heater bore 152 that is open ended so as to fit on the bottom end of the injector nozzle 149 and allow the injector nozzle 149 to extend vertically therethrough. The nozzle heater unit 150 includes heater and control wires 150A (FIG. 150A) that are offset to one side and allow the nozzle heater unit 150 to generate heat in the area of the injector nozzle 149. The nozzle heater unit 150 is held in position by fasteners such as set screws and is removable for assembly and disassembly of the machine.

The injector nozzle 149 is further modified in comparison to the injector nozzle 49 by the addition of a circulation system 152 that preferably generates a vacuum or suction within the injector nozzle 149, which is usable to both evacuate air from the cartridge bodies 14 during filling, and also to allow circulation and removal of cleaning fluid through the injector nozzle 149, which may be necessary when switching fluids being dispensed from the filling module 151.

Figure 45:
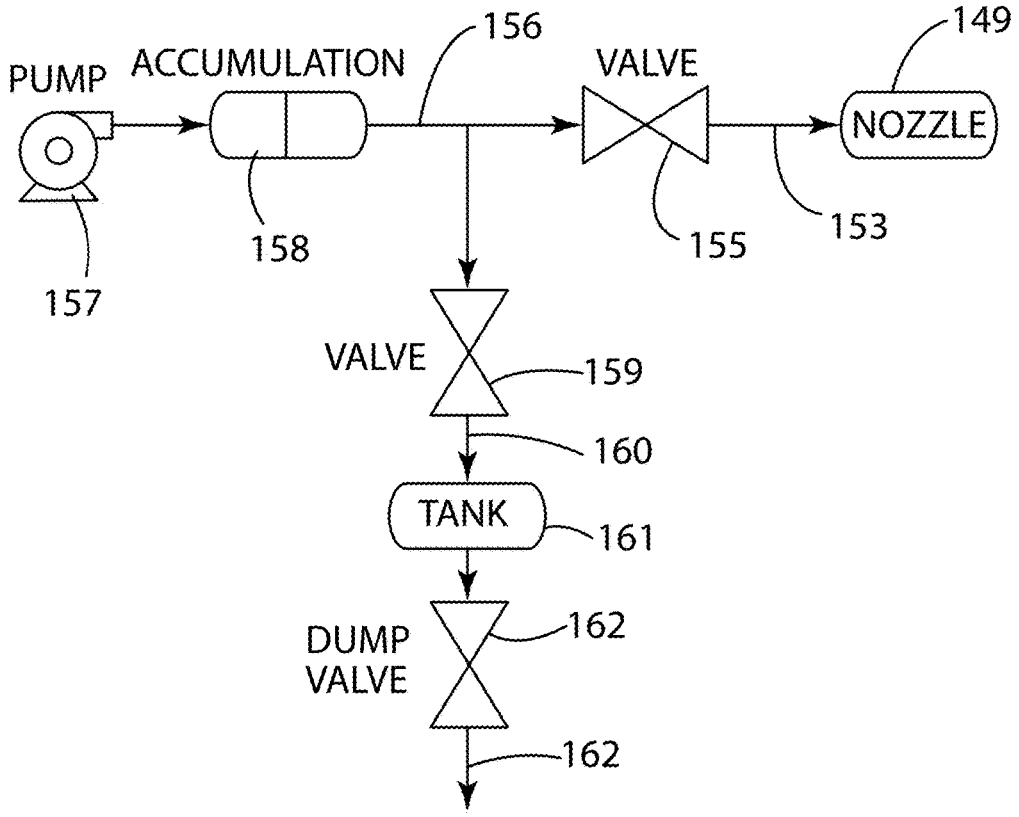
FIG. 45 diagrammatically illustrates a circulation system implemented in the injector assembly of FIG. 43.
Figure 46:
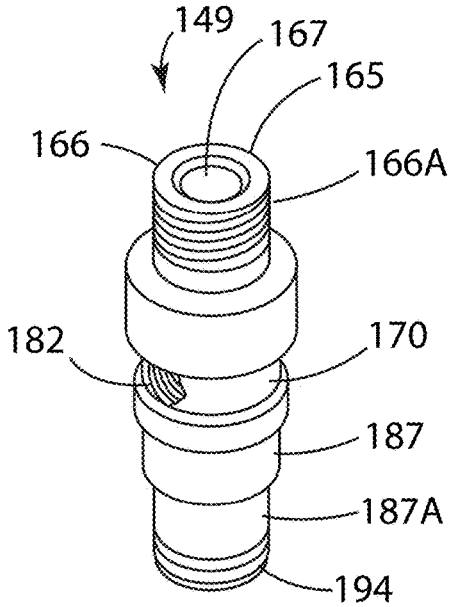
FIG. 46 is a perspective view of an alternate injector nozzle of the injector assembly.
Figure 47:
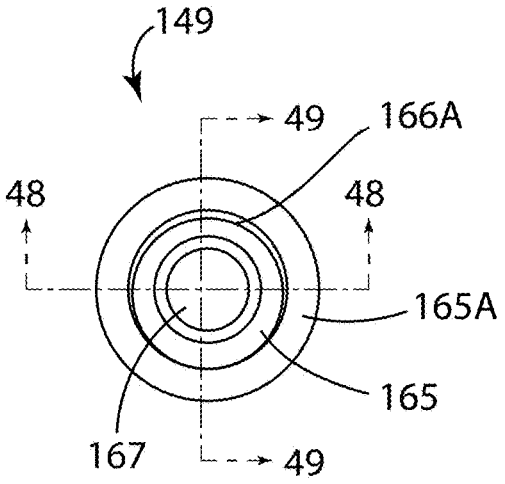
FIG. 47 is a top view thereof.

Generally, the injector nozzle 149 includes a circulation line or tube 153 connected the injector nozzle 149 by a suitable fitting 154. The circulation line 153 is connected to the remainder of the circulation system 152 for removal of air and cleaning fluid, wherein FIG. 45 diagrammatically illustrates the circulation system 152 as preferably implemented in the injector assembly 149 of FIG. 43.

The injector nozzle 149 and circulation line 153 preferably are connected to a nozzle control valve 155 that connects to an intermediate line 156 that preferably is maintained with a vacuum or negative pressure generated by a pump 157 and accumulator 158. This negative pressure serves to remove air in the injector nozzle 149 during filling as will be described further below, and also allow circulation of cleaning fluid out of the injector nozzle 149 during a cleaning cycle.

The intermediate line 156 also connects to a discharge control valve 159 that is connected by a tank line 160 that connects to a collection tank 161. The collection tank 161 is further connected to a discharge valve 162 that allows for controlled discharge of fluids from the collection tank 161 to a discharge port 162, particularly during a cleaning cycle.

In more detail as to the injector nozzle 149 as shown in FIGS. 46-49, it will be understood that the injector nozzle 149 can be installed on the above-described filling components by replacing the injector nozzle 49 with injector nozzle 149. The filling module or system essentially operates the same with the following disclosure focusing on the improved features of injector nozzle 149.

Generally, in accord with the above disclosure, the injector nozzle 149 receives the fill fluid from the storage tank or hopper 45 through the heated passages defined through the hollow standpipe 47, pump 46 and the pump passages thereof, the heater 54 and heater passages thereof, and the downstream fitting 49A, which provides rigid support to the injector nozzle 149. The injector nozzle 149 is joined to the threaded port in the heater 54 and valve 54A (that previously engaged with fitting 49A) through a hollow nozzle coupler or screw connector 165 forming the upper terminal end of the injector nozzle 149. As further seen in FIGS. 50 and 51, the nozzle coupler 165 includes a threaded connector 166 that includes external threads 166A for mounting to the heater 54 and valve 54A. The connector 166 is hollow and forms a fluid passage 167 vertically therethrough.

Here again, all fittings and components of the filling module 11 including nozzle coupler 165 define a continuous flow path for the fill fluid and may be disassembled for changeout of parts. However, the injector nozzle 149 is also modified so that it may remain installed during a cleaning cycle, which typically is needed when the fill fluid is an oil based fluid such as viscous cannabis or hemp based oils. Cleaning may be required between batches of fill fluids or when switching types of fill fluids.

The upper end of the injector nozzle 149 comprises the nozzle coupler 165, which has a downward opening cup-shape defined by a side wall 165A and end wall 165B that is configured as an injector head 168. The end wall 165B has the threaded connector 166 for mounting to the heater 54 and valve 54A. The injector head 168 defines a downward opening head chamber 169 that is internally threaded to receive and an upper end of a nozzle cover or interior body 170 (see FIGS. 52 and 53) therein. The nozzle cover 170 includes an externally threaded upper collar 171 that threads into the head chamber 169. The head chamber 169 includes a gasket channel 169A that receives a gasket 172, preferably configured as an O-ring.

Figure 48:
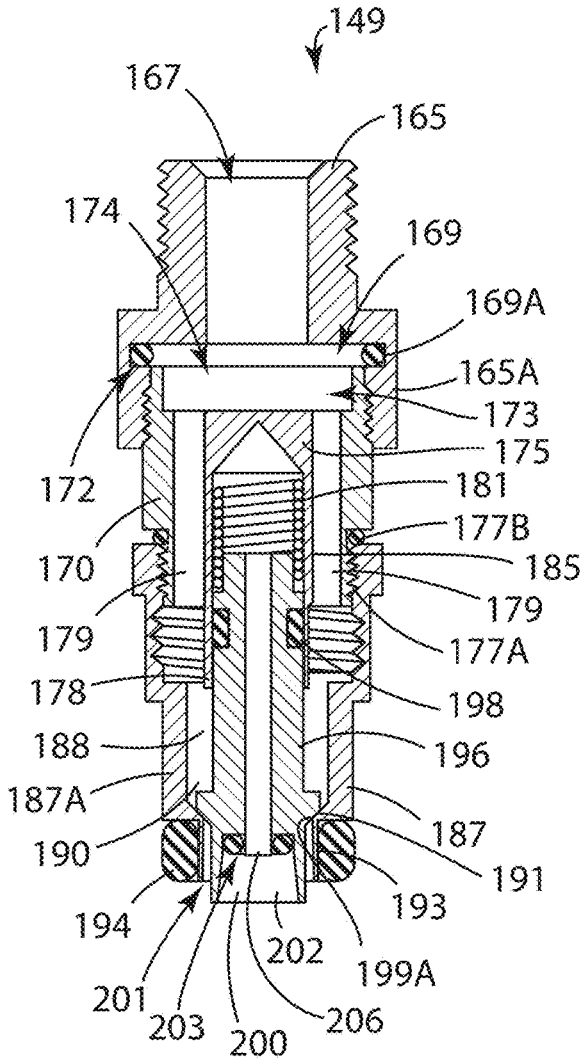
FIG. 48 is a side cross section of the injector nozzle as taken along line 48-48 of FIG. 47.
Figure 49:
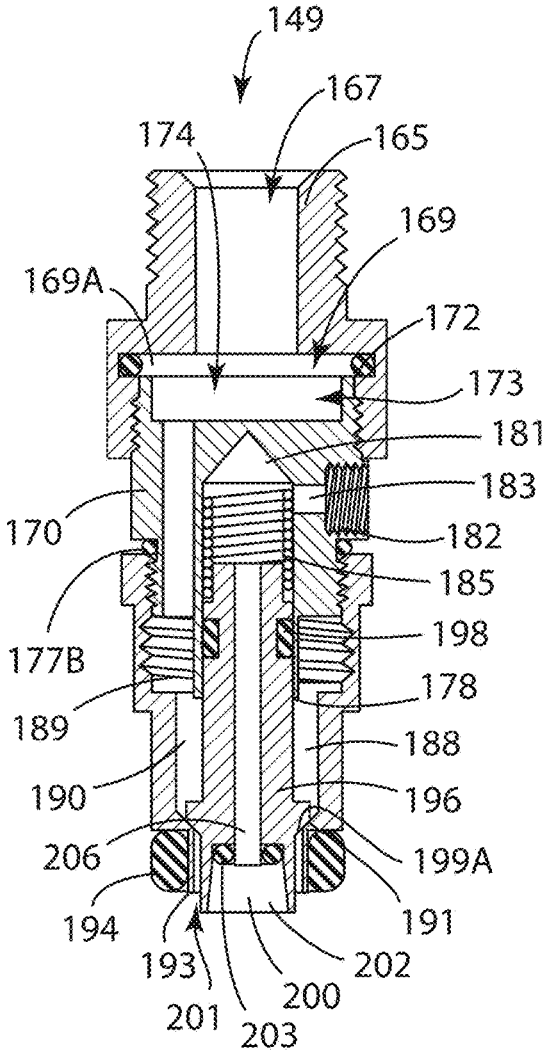
FIG. 49 is a side cross section of the injector nozzle as taken along line 49-49 of FIG. 47.
Figure 50:
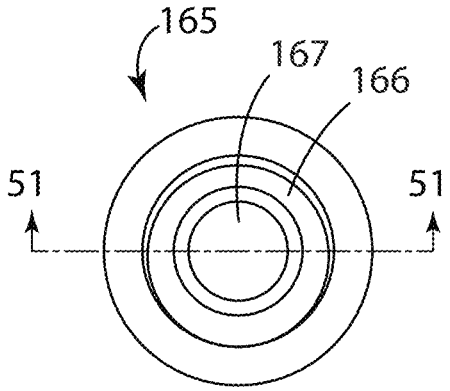
FIG. 50 is a top view of a nozzle coupler of the injector nozzle.
Figure 52:
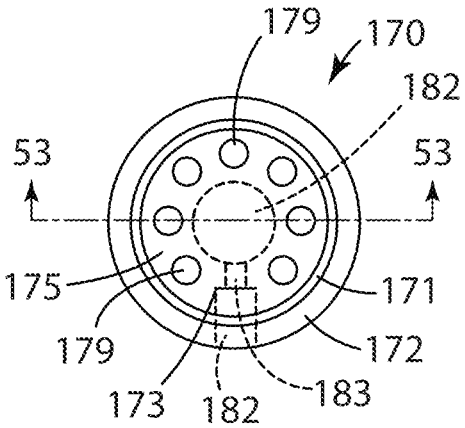
FIG. 52 is a top view of a nozzle cover of the injector nozzle.
Figure 51:
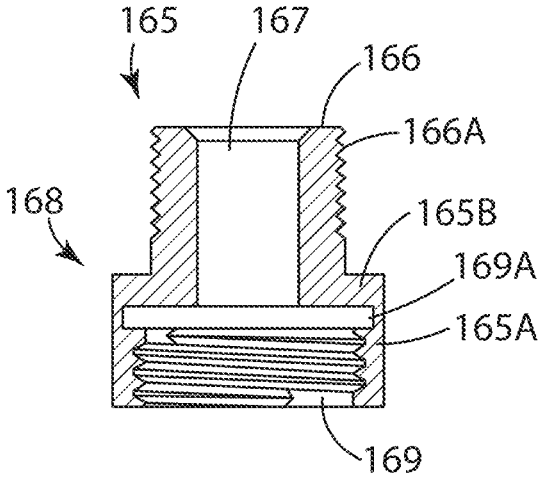
FIG. 51 is side cross section of the nozzle coupler as taken along line 51-51 of FIG. 50.
Figure 53:
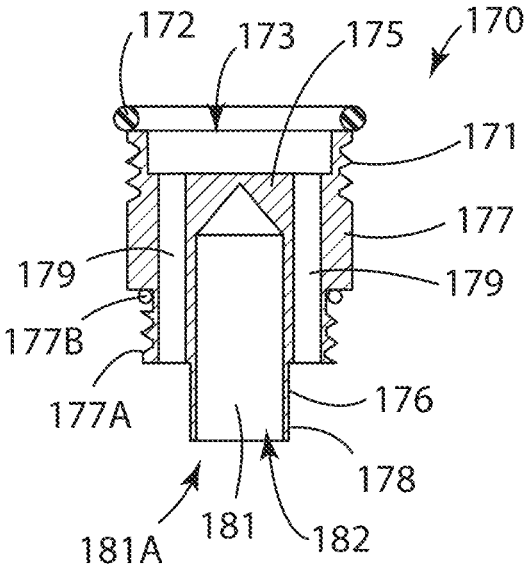
FIG. 53 is side cross section of the nozzle cover as taken along line 52-52 of FIG. 52.

The upper collar 171 of the nozzle cover 170 forms an upward opening collar chamber 173 that is in open communication with the head chamber 169 for receiving pressurized fluid therein. As seen in FIGS. 48 and 49, the upper collar 171 fits within the interior of the head chamber 169, wherein the head chamber 169 and collar chamber 173 form main fluid chamber 174 that is supplied with pressurized fill fluid through the fluid passage 167 of the hollow nozzle coupler 165.

The nozzle cover 170 is configured with a distribution plate or wall 175 that supports an interior wall 176 extending downwardly therefrom. The interior wall 176 has a thicker body section 177 and a thinner cylindrical section 178. The distribution wall 175 is formed with an array of distribution ports 179, which are circumferentially spaced apart from each along a common circle surrounding most of the circumference of the interior wall 176. The distribution ports 179 are disposed radially outwardly of the narrowest portion of the interior wall 176 formed by the cylindrical section 178 so that the distribution ports 179 allow fluid flow from the main chamber 174 to an exterior area surrounding the cylindrical section 178.

The interior of the interior wall 176 is open at the bottom to define an interior space 181 that has an open bottom 181A but is closed off from the collar chamber 173 by the distribution plate 175. Therefore, fill fluid flows from the collar chamber 173 to the exterior of the cylindrical section 178 in an annular pattern extending almost 360 degrees about the outer periphery of the wall 178.

Figure 58:
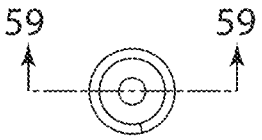
FIG. 58 is a top view of an assembly of valve components of the injector nozzle comprising a spring, a nozzle shaft and nozzle O-ring.

As seen in FIG. 49, the thicker body section 177 also is formed with a threaded fitting port 182 that opens outwardly for threaded engagement with the circulation fitting 154 (FIGS. 43 and 44), and opens inwardly into the interior space or chamber 181 through a fluid passage 183. The circulation fitting 154 connects to the fitting port 182 and allows for air and cleaning fluid to be collected from and circulated through the interior space 181. Referring to FIGS. 48, 49 and 58/59, the interior space 181 also receives a compression spring 185 therein.

Figure 54:
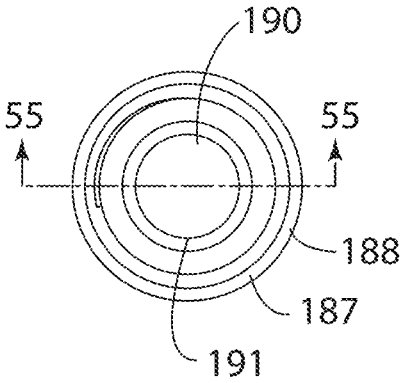
FIG. 54 is a top view of a nozzle housing of the injector nozzle.
Figure 56:
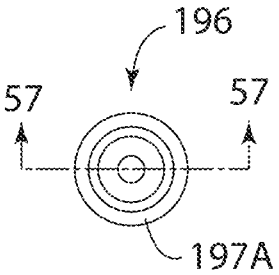
FIG. 56 is a top view of an interior body or valve poppet of the injector nozzle.
Figure 55:
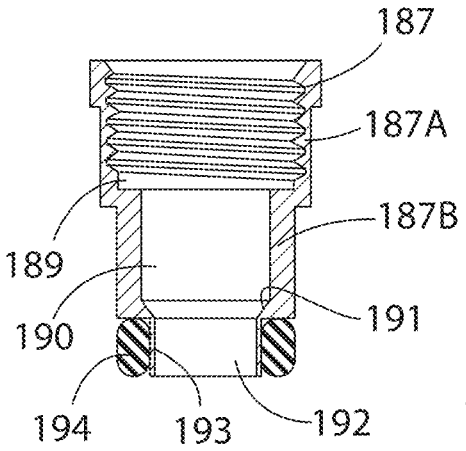
FIG. 55 is side cross section of the nozzle housing as taken along line 55-55 of FIG. 54.

The lower end of the thicker body section 177 includes an externally threaded section 177A with an O-ring type gasket 177B, which is configured for threaded, sealing engagement with nozzle cover 187 (FIGS. 54 and 55). The nozzle cover 187 includes a threaded side wall 187A that engages the external threads 177A on the body section 177 such that the thinner cylindrical section 178 is surrounded by the nozzle cover 187 in radially spaced relation.

The nozzle cover 187 includes a cover body 187B that is spaced radially outwardly of the interior cylindrical section 178 to define an annular injection passage 188, which comprises a radially enlarged inlet section 189 surrounding the cylindrical section 178 and a narrower outlet section 190 below the cylindrical wall section 178. The inlet section 189 receives fluid annularly throughout its 360 degree circumference from the distribution ports 179. The outlet section 190 terminates at a valve seat 191 and defines an annular flow path that has a circular pattern through which fluid flows downwardly toward the cartridge body 14. The fluid exits the outlet section 190 through a nozzle port 192 defined by a port wall 193 projecting downwardly below the valve seat 191.

The port wall 193 also supports an annular nozzle gasket 194 that is configured to seat against the cartridge wall of the cartridge bodies 14 during a filling cycle. During the filling cycle, the fluid is able to flow through the injection passage 188 and exit the nozzle port 192 into the open mouth of the cartridge body 14.

The injection nozzle 149 also includes a reciprocating interior sse body 196 which is slidably received in the interior chamber 181 so as to be biased downwardly by the spring 185. The valve body 196 is vertically elongate and has a main wall 197 formed with a channel 197A that receives an O-ring type gasket 198 that slidably seals against the surface of the interior chamber 181 while allowing the valve body 196 to reciprocate vertically in the interior chamber 181.

The upper end of the main wall 197 has a narrowed diameter to support and align the bottom end of the spring 185, wherein the spring 185 normally biases the valve body 196 downwardly. The bottom end of the main wall includes an annular valve flange 199 that has a tapered valve surface 199A that mates with the opposing surface of the valve seat 191 as seen in FIGS. 48 and 49.

The valve body 196 is formed with a cup-like rim or discharge section 200 that is configured to contact the cartridge body 14 to displace the valve body 196 upwardly when filling. When the valve body 196 is displaced upwardly, the valve flange 199 separates from the valve seat 191 to open the nozzle port 192 to discharge fluid therefrom. The valve body discharge section 200 and opposing port wall 193 are spaced radially and thereby define an annular injection outlet 201 for 360 degree filing of the cartridge mouth. When the injector assembly 149 is moved vertically away from the cartridge body 14 after filling, the valve body 196 automatically returns to the closed position by the spring 185.

In more detail, the discharge section 200 is spaced radially inwardly of the outer port wall 193 to define the injection outlet 202 that is configured to inject fill fluid into the cartridge body 14. When the cartridge body 14 reaches the fill position in the filling station 34, the valve body 196 and its discharge section 200 engages cartridge body 14, wherein the annular injection outlet 201 generally aligns with and opens into the open mouth 28 of the cartridge body 14 so as to inject the consumable fluid therein. In the inventive injector nozzle 149, the injection outlet 201 is formed as an annular injector passage, through which the fluid is discharged.

Figure 57:
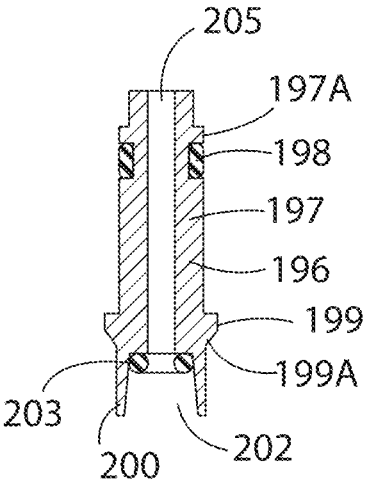
FIG. 57 is side cross section of the interior body as taken along line 57-57 of FIG. 56.
Figure 59:
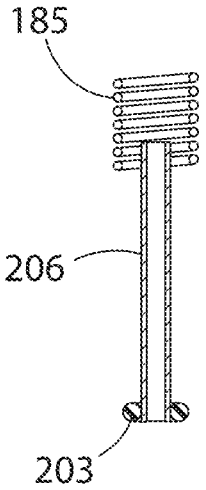
FIG. 59 is side cross section of these components as taken along line 59-59 of FIG. 58.

The discharge section 200 also defines a central chamber 202 that opens downwardly and seats a gasket 203 therein (see FIGS. 48 and 57). The central portion of the injector nozzle 149 in the region of the central chamber 202 is separated from the injection outlet or injector passage 201 by the wall-like discharge section 200 and does not dispense the fluid. The interior surface of the central chamber 202 is generally tapered.

The valve body 196 is also formed with a recirculation passage 205 having a nozzle shaft 206 (FIGS. 48 and 58/59) seated therein, wherein the gasket 202 is fitted onto the lower end of the nozzle shaft 206. The recirculation passage 205 and nozzle shaft 206 collectively define a vertical flow path through the length of the valve body 196 wherein the bottom path end of the flow path opens into the central chamber 202 and the upper path end opens into the interior space 181 near the fitting port 182 and passage 183. As such, any fluid such as air and cleaning fluid can be collected in the central chamber 202 and flow to the interior space 181 near fitting port 182. As such, the recirculation passage 205 essentially forms a discharge passage or port for discharge of air from the cartridge body. As noted, the recirculation system applies a vacuum or negative pressure, which functions to suction or withdraw any fluid (liquid or air) from the interior space 181.

In this configuration, air may be displaced out of the cartridge body 14 during filling and may be pulled out of the cartridge body 14 as consumable fluid is pumped into the cartridge body 14. This prevents the formation of air pockets or bubbles within the cartridge body 14 during the filling step, wherein the negative pressure in the central chamber 202 helps to evacuate air bubbles, particularly when the consumable fluid is thick.

In operation, the injector nozzle 149 engages with the annular mouth 28 in a generally sealed relation so that pressurized fluid is injected into the cartridge mouth 28, wherein the 360 degree or annular injection pattern and pressurized fluid also facilitates priming of the cartridge wick of the atomizer or heater preinstalled within the cartridge body 14. This provides significant advantages over known cartridge filling devices. Preferably, during a filling cycle, the vacuum pump 157 is turned on before or at the same time as the injection pump 46 so that air can be evacuated as the cartridge body 14 is being filled. The injection pump 46 operates to pressurize the consumable fluid during this step. At the end of the filling cycle, the vacuum pump 157 and injection pump 46 will be turned off until the next filling cycle. However, it is preferred to briefly operate the injection pump 46 in reverse as the valve body 196 reciprocates to the closed position. This helps terminate fluid flow into the cartridge body 14 when the valve body 196 progresses from fully open to fully closed. Therefore, the injection pump 46 preferably is a reversible pump.

Figure 60:
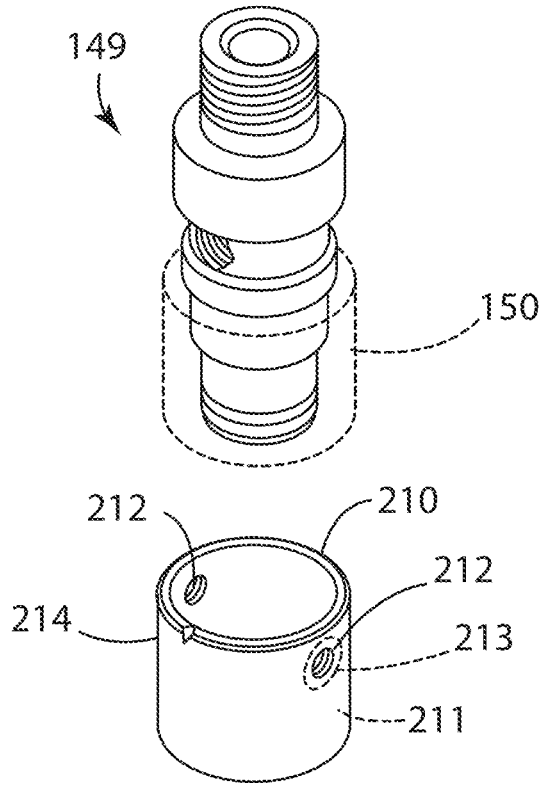
FIG. 60 is an exploded perspective view of the injector nozzle aligned with a cleaning cap for automated cleaning of the nozzle.
Figure 61:
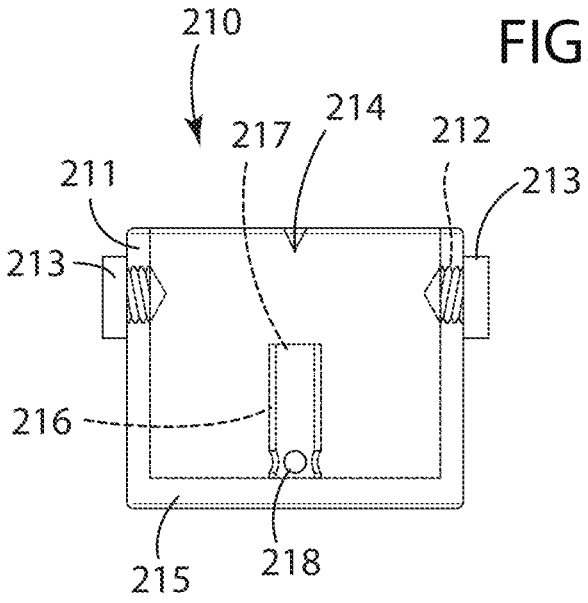
FIG. 61 is a first side view of the cleaning cap.

Turning next to cleaning of the system, FIG. 60 is an exploded perspective view of the injector nozzle 149 aligned with a removable cleaning cap 210 for automated cleaning of the injector nozzle 149. Generally, the cleaning cap 210 is installed onto the injector nozzle 149 by fitting over the exterior of the nozzle heater 150. The cleaning cap 210 has an exterior cap wall 211 formed with threaded bores 212 that mount fasteners 213 such as screws, set screws or spring biased detents that serve to removably lock the cleaning cap 210 onto the bottom end of the injector nozzle 149. The upper rim of the cap wall 211 may include a locator notch 214 to orient the cleaning cap 210 on the injector assembly 149. When installed, the bottom wall 215 preferably abuts against and seals with the bottom gasket 194 described above to prevent leakage from the cleaning cap 210.

Figure 62:
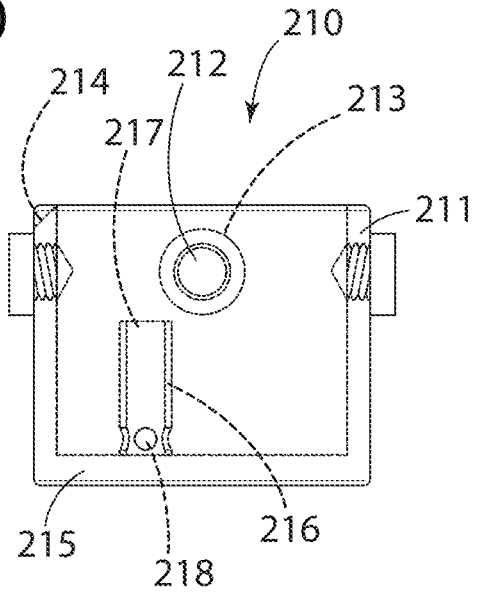
FIG. 62 is a second side view of the cleaning cap as offset 90 degrees from the side view of FIG. 61.

The bottom wall 215 also includes an upright circulation tube 216 that is hollow to form an open upper end 217. The bottom tube end is formed with radial passages 218 so that fluid can flow from the radial passages 218 to the open upper end 217 during cleaning. In more detail, when the cleaning cap 210 is installed, the open upper end 217 of the circulation tube 216 can align with and seats against the nozzle gasket 203 to displace the valve body 196 vertically and open the nozzle valve. FIG. 62 shows the circulation tube 216 eccentrically offset from the center of the cleaning cap 210, which is done due to the eccentric shape of the nozzle heater 150.

When the cleaning cap 210 is installed, the injector nozzle 149 is held open by the cap 210 and fluid is able to flow from the injector nozzle 149, through the passages 218 and circulation tube 216 to the recirculation passage 205 and nozzle shaft 206, which then communicate with the recirculation port 192 and fitting 154. During a cleaning cycle, the tank 45 has been emptied of the consumable fluid and instead is filled with an amount of cleaning fluid. The cleaning fluid preferably is a plant based cleaner that safely dissolves and removes consumable fluid from the system passages. The injection pump 46 is then operated to pump the cleaning fluid into and through the injector nozzle 149 and then into the cleaning cap 210. The cleaning fluid is able to flow through the circulation tube 216 for collection through the fitting 154.

As described above relative to FIG. 45, the circulation line or tube 153 is connected the injector nozzle 149 by the fitting 154. The circulation line 153 is connected to the remainder of the circulation system 152 for removal of air from the cartridge bodies 14 during filling and cleaning fluid during the cleaning cycle. The injector nozzle 149 and circulation line 153 are connected to the nozzle control valve 155 that connects to an intermediate line 156 that is maintained with the vacuum or negative pressure generated by a pump 157 and accumulator 158. This negative pressure allows circulation of cleaning fluid out of the injector nozzle 149 during a cleaning cycle.

The intermediate line 156 also connects to the discharge control valve 159 that is connected to the collection tank 161. The collection tank 161 is further connected to a discharge valve 162 that allows for controlled discharge of cleaning fluids from the collection tank 161 to a discharge port 162, particularly during the cleaning cycle. With this configuration, the passages can be easily cleaned in an automated cleaning cycle without requiring removal of any of the system components. The cleaning cycle may comprise a first heated cleaning segment using a cleaning fluid such as a commercial solvent, and a rinse cycle with a different fluid such as water. Once the cleaning cycle is complete, the cleaning cap 210 is removed and the tank 45 can be filled with a next batch of fluid for the next filling cycle.

Although particular preferred embodiments of the invention have been disclosed in detail for illustrative purposes, it will be recognized that variations or modifications of the disclosed apparatus, including the rearrangement of parts, lie within the scope of the present invention.

We claim:

1. A cartridge handling machine for successive filling of cartridge bodies with a viscous consumable fluid, comprising:

a filling module disposed adjacent a filling station into which each of the cartridge bodies may be placed empty and then removed after filling, wherein said filling module comprises:

a feed supply for supplying a bulk quantity of the consumable fluid which defines a fill fluid dispensed by the filling module for filling of the cartridge bodies;

a pump which receives said fill fluid from said feed supply and in turn pumps said fill fluid downstream under pressure; and an injector assembly, which receives said fill fluid under pressure from said pump and dispenses said fill fluid from an injector nozzle for injection into said cartridge body located in said filling station, said injector assembly being reversibly movable downwardly from a raised position, wherein said injector nozzle is separated from a mouth of the cartridge body, to a fill position in which said injector nozzle is engageable with the cartridge body in a filling operation during which said fill fluid is injected into said cartridge body, said injector body being displaceable after filling of the cartridge body to return to said raised position for subsequent removal of the cartridge body from the filling station after the respective filling operation, and positioning of another said cartridge body in said filling station for filling in successive filling operations;

said injector nozzle being configured for sealing engagement with an open mouth of the cartridge body to prevent leakage of the consumable fluid when pressurized during filling and having an annular injector passage that injects said fill fluid into the mouth of the cartridge body in an annular pattern.

2. The cartridge handling machine according to claim 1, wherein said injector passage extends 360 degrees about the mouth of the cartridge body which is formed with a circular shape and injects said fill fluid about the entire 360 degrees of said injector passage.

3. The cartridge handling machine according to claim 2, wherein said injector nozzle includes a discharge passage in a center portion of said injector passage for the removal of gases or air in the cartridge body which are displaced by said fill fluid during the filling operation.

4. The cartridge handling machine according to claim 1, wherein said injector assembly is configured with a valve, which is normally closed but opens when said injector nozzle is in sealing engagement with the open mouth of the cartridge body.

5. The cartridge handling machine according to claim 4, wherein said injector nozzle opens by downward displacement thereof to said fill position in contact with the cartridge body.

6. The cartridge handling machine according to claim 5, wherein said injector nozzle automatically closes said injector passage upon upward movement away from and disengagement from the cartridge body.

7. The cartridge handling machine according to claim 1, wherein said injector assembly includes a vertically reciprocating body, which selectively contacts and is displaced by movement into contact with and out of contact with the cartridge body.

8. The cartridge handling machine according to claim 1, wherein said pump is reversible to withdraw said fill fluid into said injector passage upon separation from the cartridge body.

9. The cartridge handling machine according to claim 1, wherein said fill fluid is heated by said feed supply, and at least one of said pump and said injector nozzle includes respective heaters so that said fill fluid is heated as it travels from said feed supply to said injector nozzle to maintain a set viscosity for said fill fluid.

10. The cartridge handling machine according to claim 1, which further includes a conveyor unit for feeding empty cartridge bodies to said filling station and transporting said cartridge bodies after filling away from said filling station in synchronized operation with said filling module.

11. The cartridge handling machine according to claim 10, which further includes a capping module downstream of said filling module, which defines a capping station wherein said conveyor unit transports the filled cartridge bodies from the filling station to the capping station, said capping module configured to apply caps to the open mouths of the cartridge bodies in synchronized operation with said filling module.

12. A cartridge handling machine for successive filling of cartridge bodies with a viscous consumable fluid defining a fill fluid, comprising:

a filling module disposed adjacent a filling station into which each of the cartridge bodies may be placed empty and then removed after filling, wherein said filling module comprises:

a feed supply for supplying the consumable fluid which defines a fill fluid dispensed by the filling module for filling of the cartridge bodies;

a pump which receives said fill fluid from said feed supply and in turn pumps said fill fluid downstream under pressure; and an injector assembly, which receives said fill fluid under pressure from said pump and dispenses said fill fluid from an injector nozzle for injection into said cartridge body located in said filling station, said injector assembly being reversibly movable downwardly from a raised position, wherein said injector nozzle is separated from a mouth of the cartridge body, to a fill position in which said injector nozzle is engageable with the cartridge body in a filling operation in which said fill fluid is injected into said cartridge body, said injector body being displaceable after filling of the cartridge body to return to said raised position for subsequent removal of the cartridge body from the filling station after the respective filling operation, and positioning of another said cartridge body in said filling station for filling in successive filling operations;

said injector nozzle being configured for sealing engagement with an open mouth of the cartridge body to prevent leakage of the consumable fluid when pressurized during filling, said injector nozzle defining an injection outlet injecting said fill fluid into a portion of said open mouth of said cartridge body and having a discharge passage opening into the cartridge body, which permits the removal of gases or air in the cartridge body during injection of fill fluid therein.

13. The cartridge handling machine according to claim 12, wherein said discharge passage permits a free flow of gases or air from the cartridge body, which are displaced therefrom by said fill fluid being injected therein.

14. The cartridge handling machine according to claim 12, wherein said discharge passage is subject to a vacuum pressure for removing the gases or air from the cartridge body.

15. The cartridge handling machine according to claim 12, wherein said annular injection outlet is defined about an outer periphery of said injection nozzle to conform to the open mouth of the cartridge body, said discharge passage being defined centrally of the injection outlet.

16. The cartridge handling machine according to claim 12, wherein said injection outlet and said discharge passage are configured to respectively mate with a cartridge body of a vape cartridge having an annular mouth and a central outlet tube so as to fill a cartridge chamber and facilitate priming of a wick of a heater unit.

17. The cartridge handling machine according to claim 12, wherein said pump is reversible to withdraw said fill fluid into said nozzle outlet upon separation from the cartridge body.

18. The cartridge handling machine according to claim 12, wherein said fill fluid is heated by said feed supply, and at least one of said pump and said injector nozzle includes respective heaters so that said fill fluid is heated as it travels from said feed supply to said injector nozzle to maintain a set viscosity for said fill fluid.

19. In an injector assembly for cartridge handling machine configured for successive filling of cartridge bodies with a viscous consumable fluid defining a fill fluid, said injector assembly configured to receive said fill fluid under pressure and having an injector nozzle to dispense said fill fluid for injection into said cartridge body located in a filling station, comprising the improvement wherein said injector assembly is reversibly movable downwardly from a raised position, wherein said injector nozzle is separated from a mouth of the cartridge body, to a fill position in which said injector nozzle is engageable with the cartridge body in a filling operation in which said fill fluid is injected into said cartridge body, said injector body being displaceable after filling of the cartridge body to return to said raised position for subsequent removal of the cartridge body from the filling station after the respective filling operation, and further comprising the improvement wherein said injector nozzle is configured for sealing engagement with an open mouth of the cartridge body to prevent leakage of the fill fluid when pressurized during filling, said injector nozzle defining an injection outlet injecting said fill fluid in an annular pattern into a portion of said open mouth of said cartridge body and having a central discharge passage centrally adjacent said injection outlet for opening into the cartridge body, which permits the removal of gases or air in the cartridge body simultaneously during injection of fill fluid therein.

20. The cartridge handling machine according to claim 19, wherein said discharge passage permits a free flow of gases or air from the cartridge body, which are displaced therefrom by said fill fluid being injected therein.

21. The cartridge handling machine according to claim 19, wherein said injector assembly further includes a vacuum unit connected to said discharge passage, which is thereby subject to a vacuum pressure for removing the gases or air from the cartridge body.

22. The cartridge handling machine according to claim 19, wherein said injection outlet is defined about an outer periphery of said injection nozzle to conform to the open mouth of the cartridge body, said discharge passage being defined centrally of the injection outlet for engaging with a central portion of the cartridge body.

23. The cartridge handling machine according to claim 19, wherein said injection outlet and said discharge passage are configured to respectively mate with a cartridge body of a vape cartridge having an annular mouth and a central outlet tube so as to fill a cartridge chamber and facilitate priming of a wick of a heater unit.

24. The cartridge handling machine according to claim 19, wherein said injection assembly includes a heater for maintaining a viscosity of the fill fluid.

25. A cartridge handling machine for successive filling of cartridge bodies with a viscous consumable fluid, comprising:

a filling module disposed adjacent a filling station into which each of the cartridge bodies may be placed empty and then removed after filling, wherein said filling module comprises:

a feed supply tank storing a supply of a consumable fluid which defines a fill fluid dispensed by the filling module for filling of the cartridge bodies;

a pump which receives said fill fluid from said feed supply and in turn pumps said fill fluid downstream under pressure; and an injector assembly, which receives said fill fluid under pressure from said pump and includes an injector nozzle, which dispenses said fill fluid for injection into said cartridge body located in said filling station, said injector assembly being reversibly movable downwardly from a raised position, wherein said injector nozzle is separated from a mouth of the cartridge body, to a fill position in which said injector nozzle is engageable with the cartridge body in a filling operation, said injector body further being displaceable away from the filling station after filling of the cartridge body to return to said raised position for subsequent removal of the cartridge body from the filling station;

said injector nozzle being configured for sealing engagement with an open mouth of the cartridge body to prevent leakage of said fill fluid when pressurized during filling, wherein said injector nozzle has a shaped injector passage that conforms to and injects said fill fluid into the mouth of the cartridge body in a shaped pattern and has a discharge passage for collecting gases displaced from the cartridge body.

26. The cartridge handling machine according to claim 25, which further comprises a carriage supported on a base and reversibly movable toward and away from said filling station, wherein said feed supply tank, said pump and said injector assembly are fixed to said carriage and movable together by movement of said carriage.

27. The cartridge handling machine according to claim 26, wherein said feed supply tank, said pump and said injector assembly include respective heaters to maintain a set viscosity for said fill fluid.

28. The cartridge handling machine according to claim 25, wherein said feed supply tank, said pump and said injector assembly include respective heaters to maintain a set viscosity for said fill fluid.

29. The cartridge handling machine according to claim 28, wherein at least said heaters on said pump and said feed supply tank are band heaters wrapped about exterior surfaces of said pump and said feed supply tank.

30. The cartridge handling machine according to claim 25, wherein said pump is reversible to pump said fill fluid to and draw said fill fluid away from said injector nozzle.

31. The cartridge handling machine according to claim 30, wherein said discharge passage is connected to a vacuum unit for generating a suction therein, said feed supply tank being selectively fillable with said fill fluid or a cleaning fluid for cleaning fill fluid from said cartridge handling machine when switching one said fill fluid to another type of said fill fluid.

32. The cartridge handling machine according to claim 31, wherein said vacuum unit is selectively operated to withdraw gas or air from said cartridge body through said discharge passage during a filling operation or withdraw said cleaning fluid during a cleaning operation.

33. The cartridge handling machine according to claim 25, wherein said filling module is provided in combination with a capping module which provides for synchronized filling of the cartridge bodies with viscous consumable oils as the fill fluid and capping of the cartridges with a cap, such as a mouthpiece or other cap device.

34. The cartridge handling machine according to claim 25, wherein said filling module operates in conjunction with a conveyor assembly which operates to sequentially convey and feed empty cartridge bodies to said filling module.

35. In an injector assembly for cartridge handling machine configured for successive filling of cartridge bodies with a viscous consumable fluid defining a fill fluid, said injector assembly configured to receive said fill fluid under pressure and having an injector nozzle to dispense said fill fluid for injection into said cartridge body located in a filling station, comprising the improvement wherein said injector nozzle is configured for sealing engagement with an open mouth of the cartridge body to prevent leakage of the fill fluid when pressurized during filling, said injector nozzle defining an injection outlet injecting said fill fluid in an annular pattern into a portion of said open mouth of said cartridge body and having a central discharge passage centrally separated from said injection outlet by an intermediate wall and configured for opening into a central portion of the cartridge body, which permits the removal of gases or air in the cartridge body simultaneously during injection of fill fluid therein, said injection outlet and said discharge passage being separated for separated communication with passages of the cartridge body that said gases or said air may be displaced out of the cartridge body to prevent the formation of gas or air pockets or bubbles within the cartridge body during the filling operation.

36. The injector assembly according to claim 35, wherein said injection outlet has a 360 degree annular injection pattern surrounding said discharge passage to define a flow of pressurized fluid and discharge of air, which facilitates priming of a cartridge wick of an atomizer preinstalled within the cartridge body.

37. A cartridge handling machine for successive filling of cartridge bodies with a viscous consumable fluid, comprising:

a filling module disposed adjacent a filling station into which each of the cartridge bodies may be placed empty and then removed after filling, wherein said filling module comprises:

a feed supply for supplying a bulk quantity of the consumable fluid which defines a fill fluid dispensed by the filling module for filling of the cartridge bodies; and an injector assembly, which receives said fill fluid from said feed supply and dispenses said fill fluid from an injector nozzle for injection into said cartridge body located in said filling station, said injector nozzle being reversibly movable downwardly from a raised position, wherein said injector nozzle is separated from the cartridge body, to a fill position in which said injector nozzle is engageable with the cartridge body in a filling operation during which said fill fluid is injected into said cartridge body, said injector nozzle being displaceable after filling of the cartridge body to return to said raised position;

said injector nozzle being configured for sealing engagement with an open mouth of the cartridge body to prevent leakage of the consumable fluid when pressurized during filling and having an annular injector passage that injects said fill fluid into the mouth of the cartridge body in an annular pattern.

38. The cartridge handling machine according to claim 37, wherein said injector passage extends 360 degrees about the mouth of the cartridge body and injects said fill fluid about the entire 360 degrees of said injector passage.

39. The cartridge handling machine according to claim 38, wherein said injector nozzle includes a discharge passage centrally of said injector passage for the removal of gases or air in the cartridge body which are displaced by said fill fluid during the filling operation.

40. The cartridge handling machine according to claim 37, wherein said injector nozzle is configured with a valve, which is normally closed when said injector nozzle is in said raised position and opens when said injector nozzle is in said fill position.

41. The cartridge handling machine according to claim 40, wherein said valve of said injector nozzle opens by downward displacement thereof to said fill position in contact with the cartridge body.

42. The cartridge handling machine according to claim 41, wherein said injector nozzle automatically closes said injector passage upon upward movement away from and disengagement from the cartridge body.

43. The cartridge handling machine according to claim 37, wherein said injector nozzle includes a vertically reciprocating body, which selectively contacts and is displaced by movement into contact with and out of contact with said cartridge body.

* * * * *